US010557089B2

(12) United States Patent
Perez-Cordova

(10) Patent No.: US 10,557,089 B2
(45) Date of Patent: Feb. 11, 2020

(54) EMULSION AND SYSTEM FOR CATALYTIC PYROLYSIS

(71) Applicant: Racional Energy & Environment Company, Conroe, TX (US)

(72) Inventor: Ramon Perez-Cordova, Conroe, TX (US)

(73) Assignee: Racional Energy & Environment Company, Conroe, TX (US)

( * ) Notice: Subject to any disclaimer, the term of this patent is extended or adjusted under 35 U.S.C. 154(b) by 0 days.

(21) Appl. No.: 16/433,021

(22) Filed: Jun. 6, 2019

(65) Prior Publication Data

US 2019/0300796 A1 Oct. 3, 2019

Related U.S. Application Data

(62) Division of application No. 14/957,659, filed on Dec. 3, 2015, now Pat. No. 10,336,946.

(Continued)

(51) Int. Cl.

| | |
|---|---|
| ***C10G 11/04*** | (2006.01) |
| ***C10G 11/02*** | (2006.01) |
| ***C10G 11/08*** | (2006.01) |
| ***C10G 11/16*** | (2006.01) |
| *B01F 3/08* | (2006.01) |

(52) U.S. Cl.

CPC ..... *C10G 11/04* (2013.01); *C10G 11/02* (2013.01); *C10G 11/08* (2013.01); *C10G 11/16* (2013.01); *B01F 2003/0842* (2013.01)

(58) Field of Classification Search

None

See application file for complete search history.

(56) References Cited

U.S. PATENT DOCUMENTS

| | | | |
|---|---|---|---|
| 2,088,214 | A | 7/1937 | Pfirrmann |
| 2,455,696 | A | 12/1948 | Mosesman |

(Continued)

FOREIGN PATENT DOCUMENTS

| | | |
|---|---|---|
| CA | 2470695 | 12/2004 |
| CN | 101786685 A | 11/2011 |

(Continued)

OTHER PUBLICATIONS

Bach, Robert D. et al., "Thermochemistry of Iron Chlorides and Their Positive and Negative Ions," J. Phys. Chem. 100, 8770-8776 (1996).

(Continued)

*Primary Examiner* — Derek N Mueller

(74) *Attorney, Agent, or Firm* — Daniel N. Lundeen; Lundeen & Lundeen PLLC

(57) ABSTRACT

An emulsion and system for catalytic pyrolysis can include a mixture of 100 parts by weight heavy oil, 5 to 100 parts by weight water, and 1 to 20 parts by weight solid catalyst particulates, which can include an oxide or acid addition salt of a Group 3-16 metal on a mineral support, such as ferric chloride on bentonite. Also, a pyrolysis system can include a charge of the emulsion, a transfer line to supply the emulsion to a pyrolysis chamber, a combustion gas source to supply a combustion gas to heat the pyrolysis chamber, a control system to maintain the pyrolysis chamber at a temperature, pressure and residence time to form a pyrolyzate vapor phase, and a vapor line to receive the pyrolyzate vapor phase from the pyrolysis chamber.

22 Claims, 11 Drawing Sheets

Related U.S. Application Data

(60) Provisional application No. 62/087,148, filed on Dec. 3, 2014, provisional application No. 62/087,164, filed on Dec. 3, 2014.

(56) References Cited

U.S. PATENT DOCUMENTS

| | | | |
|---|---|---|---|
| 2,835,553 | A | 5/1958 | Rufford et al. |
| 3,173,853 | A | 3/1965 | Peralta |
| 3,213,037 | A | 10/1965 | Hodgkiss |
| 3,544,650 | A | 12/1970 | Garwood |
| 3,544,659 | A | 12/1970 | Schwab et al. |
| 3,721,632 | A | 3/1973 | Miller et al. |
| 3,926,847 | A | 12/1975 | Beard et al. |
| 3,960,706 | A | 6/1976 | McCollum et al. |
| 3,979,332 | A | 9/1976 | Kiovsky et al. |
| 4,039,651 | A | 8/1977 | Knoche |
| 4,405,445 | A | 9/1983 | Kovach et al. |
| 4,545,974 | A | 10/1985 | Thompson |
| 4,557,821 | A | 12/1985 | Lopez et al. |
| 4,743,357 | A | 5/1988 | Patel et al. |
| 4,804,803 | A | 2/1989 | Schmidt et al. |
| 5,688,395 | A | 11/1997 | Carrazza et al. |
| 5,885,441 | A | 3/1999 | Pereira et al. |
| 6,774,149 | B1 | 8/2004 | Gagnon |
| 7,585,406 | B2 | 9/2009 | Khadzhiev et al. |
| 8,006,758 | B2 | 8/2011 | Reynolds et al. |
| 8,372,441 | B2 | 2/2013 | Thompson et al. |
| 8,455,405 | B2 | 6/2013 | Chakrabarty |
| 8,481,602 | B2 | 7/2013 | Gagnon |
| 8,663,607 | B2 | 3/2014 | Monzyk et al. |
| 2007/0113736 | A1 | 5/2007 | Bandosz |
| 2011/0059009 | A1 | 3/2011 | Amendola |
| 2014/0315764 | A1 | 10/2014 | Perez-Cordova |
| 2014/0360917 | A1 | 12/2014 | Park et al. |
| 2016/0039669 | A1 | 2/2016 | Brunet |

FOREIGN PATENT DOCUMENTS

| | | |
|---|---|---|
| EP | 1496016 | 1/2005 |
| EP | 1386881 | 7/2016 |
| GB | 902338 | 8/1962 |
| GB | 2313131 | 11/1997 |
| JP | 2015164909 | 9/2015 |
| WO | 2013066089 | 5/2013 |

OTHER PUBLICATIONS

Bouarab, R. et al., "Hydrogen Production from the Water-Gas Shift Reaction on Iron Oxide Catalysts," Hindawi Publishing Company, Journal of Catalysts, vol. 2014, Articl ID 612575, [http://]dx.doi.org/10.1155/2014/612575.

Cetco, Technical Breference GN-001, "Sodium Bentonite: Its Structure and Properties," (2013).

Eser, Semih, "Chemistry of Catalytic Cracking," Penn State, FSC 432 Petroleum Processing, downloaded from [https://www.]e-education.psu.edu/fsc432/content/chemistry-catalytic-cracking Jun. 6, 2018.

Extended EP Search Report, EP A 15866292, dated Jun. 6, 2018.

Freyland, W., "Coulombic Fluids," Springer Series in Solid-State Sciences 169, DOI 10.1007/978-3-642-17779-8 2, Springer-Verlag Berlin Heidelberg (2011).

Funai, S. et al., "Recovery of useful lighter fuels from petroleum residual oil by oxidative cracking with steam using iron oxide catalyst," Chemical Engineering Science [online], Jan. 1, 2010 (Jan. 1, 2010) [Retrieved on Aug. 3, 2016), vol. 54, Issue 1, Retrieved from Internet: <DOI: 10.1016/j.ces.2009.03.028>, pp. 60-65.

Ghosh, Upasana et al., "Review—Hydrocracking using Different Catalysts," Chemical and Process Engineering Reseawrch, vol. 345 (2015). Iron.atomistry.com/ferric_chloride.html, "Ferric chloride, FeCl3," available at [http://]ironatomistry.com/ferric_chloride.html, (2008).

International Search Report, PCT/US2015/063582, dated Jun. 8, 2016.

Johnstone, H.F., "The System Ferric Chloride-Sodium Chloride," Contribution from the Division of Chemical Engineering, Noyes Chemical Laboratory, University of Illinois, Feb. 1942.

Kanungo, S.B. et al., Abstract, "Thermal Dehydration and Decomposition of FeCh.xH2O," Journal of Thermal Analysis, vol. 46, 1487-1500 (1996).

Knauth, H.-D. et al., "Equilibrium Constant of the Gas Reaction Cl2O+H20=2HOCl and the Ultraviolet Spectrum of HOCl," The Journal of Physical Chemistry, vol. 83, No. 12 (1979).

Koenig, "The Chemistry of the Metals," pp. 195-196 (1902).

Milliken, T.H., "Use of Clays as Petroleum Cracking Catalysts," Clay Technology in the Petroleum Industry, Clays and Clay Technology, Bull. 169, Part VIII, p. 314, (Jan. 1952).

Monin, et al., "Thermal Cracking of Heavy-Oil/Mineral Matrix Systems," SPE Reservoir Engineering, 1243, Nov. 1988.

Muthuvel, I. et al., "A new solid acid catalyst FeCl3/bentonite for aldol condensation under solvent-free condition," Indian Journal of Chemistry, vol. 55B, pp. 252-260 , Feb. 2016.

Pradisty, Novia Arinda et al., "Fe(III) Oxide-modified Indonesian Bentonite for Catalytic Photodegradation of Phenol in Water," Makara Journal of Science, 21/1. 25-33 (2017).

Rytwo, Giora, "Exchange Reactions in the Ca—Mg—Na-Montmorillonite System," Clays and Clay Minerals, Vo.44, No. 2, 276-285 (1996).

Sheth, Atul C. et al., "Catalytic Gasification of Coal Using Eutectic Salts: Recovery, Regeneration, and Recycle of Spent Eutectic Catalysts," Journal of the Air and Waste Management Association, 53:4, 451-460, DOI: 10.1080/10473289.2003.10466179 (2012).

Written Opinion, PCT/US2015/063582, dated Jun. 8, 2016.

Yang, Xue-jing et al., "Iron Oxychloride (FeOCl): an Efficient Fenton-like catalyst for Producing Hydroxyl Radical in Degradatiuon of Organbic Contaminants," Journal of the American Chemical Society, 2013, 135, 16058-16061 (2013).

Recommended Practice for Field Testing Oil-Based Drilling Fluids, API Recommended Practice 13B-2, Fifth Edition [Draft], Apr. 12, 2012; retrieved from internet (http://ballots.api.org/ecs/sc13/ballots/docs/12b-2-5th-Ed-Draft-20120424.pdf), 156 pp; entire document.

Wong, S. et al., Crude oil emulsion: A review on formation, classification, and stability of water-in-oil emulsions, Journal of Petroleum Science and Engineering, 2015, vol. 135, pp. 498-504, Abstract.

Fumoto et al., Recovery of Useful Hydrocarbons from Petroleum Residual Oil by Catalytic Cracking with Steam over Zirconia-Supporting Iron Oxide Catalyst, Energy & Fuels, 2004, 18, 1770-1774.

PCT/US15/63582; Invitation to Pay Additional Fees; dated Mar. 24, 2016.

AlHumaidan, Faisal et al., "NMR Characterization of Asphaltene Derived from Residual Oils and Their Thermal Decomposition," Energy Fuels, 31, 3812-3820 (2017) [DOI: 10.1021/acs.energyfuels.6b03433].

Amani, Mahmood et al., "An Experimental Study on the Application of Ultrasonic Technology for Demulsifying Crude Oil and Water Emulsions," J Pet Environ Biotechnol 7:330 (2017) [Doi: 10.4172/2157-7463.1000330].

Ludwig, Jeffrey et al., "Dynamics of the Dissociation of Hydrogen on Stepped Platinum Surfaces Using the ReaxFF Reactive Force Field," J. Phys. Chem. B., 110, 4274-4282 (2006).

Rhode, Norman Gene, "Some Thermodynamic Properties of Aqueous Ferrous Chloride or Ferric Chloride-Hydrochloric Acid Solutions," Ph. D. Thesis, Oklahoma State University (1963).

Suganuma, Kyoko et al., "Thermal Decomposition of Iron(II) Chloride," Nippon Kagaku Kaishi, vol. 1978, Issue 3, pp. 319-325, doi: 10.1246/nikkashi.1978.319 (1978).

Cremer et al., High Temperature Reactor and Process Applications, 19. Water splitting processes of the iron-chlorine family (2015) [doi: 10.1680/htrapa.00049.0021].

Hancsók, J et al., Importance of isoparaffins in the crude oil refining industry. Chem Eng Trans 11:41-46 (2007).

José-Alberto, Murillo-Hernández, and Aburto Jorge. "Current knowledge and potential applications of ionic liquids in the petroleum

(56) References Cited

OTHER PUBLICATIONS industry." Ionic liquids: applications and perspectives (2011). [downloaded from www.intechopen.com/download/pdf/13736].
Li, Shaoping et al., Distillation Yields and Properties from Blending Crude Oils: Maxila and Cabinda Crude Oils, Maxila and Daqiing Crude Oils, Energy & Fuels 21, 1145-1150 (2007).
Naghizada, Nazim, Uncatalyzed hydrogen transfer during 100-250° C. conversion of asphaltenes, M.S. Ch. E. thesis, University of Alberta (2017).
Nanda, Arun K., "The kinetics of the reverse Deacon reaction" (1981). Retrospective Theses and Dissertations. 6837. [downloaded from lib.dr.iastate.edu/rtd/6837].
Redko, Mikhail Y. et al., "'Inverse Sodium Hydride' : A crystalline salt that contains H+ and Na−," JACS Communications, J. Am. Chem. Soc. 124, 5928-5929 (2002).
Rizo-Acosta, Pavel et al., Maya Crude Oil Primary Naphtha Thermal Cracking Representation by Model Compounds from Piona Analysis, Int. J. Engg. Res. & Sci. & Tech. 4, 4 (Nov. 2015).
Yang, Xue-jing et al., "The generation of hydroxyl radicals by hydrogen peroxide decomposition on FeOCl/SBA-15 catalysts for phenol degradation," AlChE Journal 61, 1, 166 (2015) [DOI 10.1002/aic.14625].

EMULSION AND SYSTEM FOR CATALYTIC PYROLYSIS

CROSS REFERENCE TO RELATED APPLICATIONS

This application is a divisional of U.S. Ser. No. 14/957,659, filed Dec. 3, 2015, now U.S. Pat. No. 10,336,946; which claims priority benefit to my earlier U.S. provisional application nos. 62/087,148, filed Dec. 3, 2014, and 62/087,164, filed Dec. 3, 2014, which are herein incorporated by reference in their entirety.

BACKGROUND

Heavy crude oil (or simply heavy oil), including extra heavy crude oil (or simply extra heavy oil) and bitumen, is any crude oil that cannot easily flow to production wells under normal reservoir conditions due to high viscosity. As used herein, heavy oil is any viscous petroleum with an API gravity less than 22.3° (s.g. greater than 0.920), and extra heavy oil has an API gravity less than 10° (s.g. greater than 1.0), including waste oils, extra heavy oil, and bitumen. Extra heavy oil having a viscosity greater than 10 Pa-s (10,000 cP) is often called bitumen, e.g., natural bitumen from oil or tar sands. Heavy oil typically contains a relatively high proportion of high molecular weight (60 carbon atoms or more) non-paraffinic hydrocarbons, which may or may not include high levels of resins and/or asphaltenes. Waste oil includes oil-based drilling fluids and substrates from drilling, crankcase oil, machine oil, basic sediment and water (BS&W), process emulsions, and the like.

Almost 70% of present world oil reserves are comprised of heavy and extra heavy crude oils. Popular, but complex and/or inefficient, heavy oil production at the formation includes cold heavy oil production with sand (CHOPS), steam assisted gravity drainage (SAGD), water steam injection, toe-to-heel air injection (THAI), viscosity modifiers, cyclic solvent injection (CSI), vapor extraction (VAPEX), cyclic production with continuous solvent injection (CPCSI), and others, which achieve only temporary physical changes; as well as open-pit mining where the heavy oil has a high sand content. Some variants include injection of one or more treatment fluids, sometimes with the input of heat, into an injection well located proximate to one or more production wells, with flow from the injection well towards the production wells resulting in the release of hydrocarbons in the subterranean formation. Economic factors generally require such treatment fluids and processes to be efficient, and utilize relatively inexpensive materials. A common problem is that not all crude oil constituents, e.g., asphaltenes, are soluble in the treatment fluid, and they can drop out of the reservoir fluid and reduce the permeability of the producing formation.

The physical nature of heavy oils and waste oils also complicates their use. Properties such as flash point, viscosity, lower pour point, specific gravity, aromatics content and/or functional group content may render recovered oil unsuitable and/or challenging for various end uses. The process or processing equipment utilized to remove and/or upgrade the oil may require excessive amounts of energy, require a long treatment time, require large pieces of equipment not easily transported to a processing site, require excessive capital for non-economical equipment, or entail excessive operational risks or other hazards, all of which present significant challenges. Other issues include the quality of the oil obtained, which may not be suitable for pipeline transport without significant treatment such as upgrading or dilution. Numerous attempts have been tried to recover or remove a useful oil from heavy oils and waste oils with limited success. The industry has had a long-felt need to address the quantity of useful oil recovered, which may be very low relative to the total amount of heavy oil produced and/or processed.

For example, many oil upgrading processes are operated at high pressure, e.g., greater than about 10 or 20 atm (about 150 or 300 psig), may require the use of specialized and/or expensive catalysts that may require recovery and regeneration; and/or may also require a separate process unit to supply hydrogen for the upgrading process.

There exists a need for efficient ways and apparatus to upgrade heavy oil, in an environmentally responsible manner, and that can be operated at low pressure and/or with an inexpensive catalyst and/or without adding hydrogen and/or with a high upgraded oil recovery.

SUMMARY

The present disclosure is directed to a method and apparatus for processing heavy oil including heavy crude oil, waste oil, oil based substrates, and the like. Processes according to embodiments disclosed herein include a catalytic pyrolysis process by which the boiling point or carbon number of a heavy oil is reduced, for example, heavy oil can be converted into a medium oil (API gravity between 22.3 and 31.1° (s.g. 0.87 to 0.92)) or light oil (API gravity greater than 31.1° (s.g. less than 0.87)). Accordingly, the instant application is directed to catalytic pyrolysis processes, the equipment utilized therein, and the use of the catalytic pyrolysis oil product of such processes. This is in contrast to traditional pyrolysis processes, wherein a large proportion of a liquid hydrocarbon may be typically converted into non-condensable hydrocarbons having from 1 to about 4 carbons, carbon monoxide (CO), and/or carbon dioxide ($CO_2$).

In an embodiment, a process comprises feeding to a reactor a feed mixture comprising 100 parts by weight heavy oil (API<22.3, preferably API<20), from about 5 to 100 parts by weight water, and from about 1 to 20 parts by weight solid catalyst particulates comprising a mineral support and an oxide or acid addition salt of a Group 3-16 metal, and heating the feed mixture in the reactor at a temperature, pressure, and for a period of time sufficient to produce a pyrolyzate vapor phase at an exit from the reactor, condensable to form an oil phase lighter than the heavy oil. In a preferred embodiment, the solid catalyst comprises thermally processed oil based drill cuttings (OBDC) or materials similar to OBDC in catalytic properties. In some embodiments, the process can be effected with a low pressure in the reactor, e.g., from and without the addition of exogenous hydrogen, in contrast to prior art upgrading processes typified by the use of specialized catalysts, the requirement to add hydrogen to the reactor, and the use of much high pressures.

In some embodiments according to the invention, the process further comprises injecting a treatment fluid comprising the pyrolyzate into a subterranean injection well at a temperature, a pressure, and in an amount sufficient to produce a flow of hydrocarbons, especially heavy oil (API<22.3, preferably API<20), in the formation away from the injection well. In some embodiments the treatment fluid comprises the pyrolyzate vapor phase, which may be injected hot, substantially without cooling, and/or compressed prior to the injection. In some embodiments, the treatment fluid comprises steam and/or combustion effluent gases from the pyrolyzate vapor phase. In some embodiments, the pyrolyzate is recovered from the pyrolyzate vapor phase and injected as a liquid and/or vapor into the injection well. In some embodiments, the treatment fluid is essentially free of noncondensable gases. In some embodiments asphaltenes, especially those occurring in the formation, are more soluble in the pyrolyzate than in the heavy oil in the reservoir.

In an embodiment, an emulsion comprises 100 parts by weight heavy oil, from about 5 to 100 parts by weight water, and catalyst particulates comprising a mineral support and an oxide or acid addition salt of a Group 3-16 metal. The emulsion preferably has an electrical stability of greater than 1600 V, when determined according to API 13B-2 at 130° C., more preferably greater than 1700 V, 1800 V, 1900 V, or 2000 V. In some embodiments, the emulsion has an apparent viscosity at 30° C. and 100 $s^{-1}$ at least 30% lower than the heavy oil alone.

In an embodiment, an apparatus comprises a heavy oil (API<22.3, preferably API<20) source, a water source, a catalyst particulate source, wherein the catalyst particulates comprise a mineral support and an oxide or acid addition salt of a Group 3-16 metal, a mixing zone to combine 100 parts by weight of the heavy oil, from about 5 to 100 parts by weight water, and from about 1 to 20 parts by weight solid catalyst particulates into a feed mixture comprising an emulsion, e.g., a low viscosity emulsion, a transfer line to supply the emulsion from the mixing zone to a pyrolysis zone, a combustion gas source to supply a combustion gas to heat the pyrolysis zone, a control system to maintain the pyrolysis zone at a temperature, pressure and residence time to form a pyrolyzate vapor phase, and a vapor line to receive the pyrolyzate vapor phase from the pyrolysis zone.

DETAILED DESCRIPTION

Figure 1:
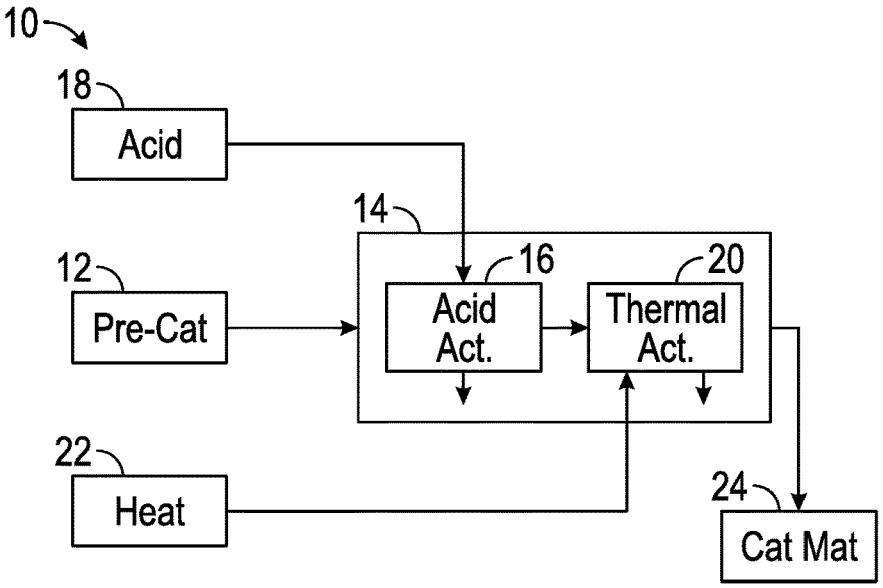
FIG. 1 shows a schematic diagram of a process to produce catalyst according to an embodiment of the invention.

Throughout the entire specification, including the claims, the following terms shall have the indicated meanings.

As used in the specification and claims, "near" is inclusive of "at." The term "and/or" refers to both the inclusive "and" case and the exclusive "or" case, whereas the term "and or" refers to the inclusive "and" case only and such terms are used herein for brevity. For example, a component comprising "A and/or B" may comprise A alone, B alone, or both A and B; and a component comprising "A and or B" may comprise A alone, or both A and B.

All percentages are expressed as weight percent (wt %), based on the total weight of the particular stream or composition present, unless otherwise noted. All parts by weight are per 100 parts by weight heavy oil, adjusted for water and/or solids in the oil sample (net oil), unless otherwise indicated. Parts of water by weight include water added as well as water present in the heavy oil.

Room temperature is 25° C. and atmospheric pressure is 101.325 kPa unless otherwise noted.

For purposes herein, API refers to the American Petroleum Institute gravity (API gravity), which is a measure of the density of a petroleum product at 15.6° C. (60° F.) compared to water at 4° C., and is determined according to ASTM D1298 or ASTM D4052, unless otherwise specified. The relationship between API gravity and s.g. (specific gravity) is API gravity=(141.5/s.g.)−131.5.

For purposes herein, viscosity is determined at 30° C. and 100 $s^{-1}$, or if the viscosity cannot be so determined at 30° C., the viscosity is measured at higher temperatures and extrapolated to 30° C. using a power low equation.

As used herein, asphaltenes refer to compounds which are primarily composed of carbon, hydrogen, nitrogen, oxygen, and sulfur, but which may include trace amounts of vanadium, nickel, and other metals. Asphaltenes typically have a C:H ratio of approximately 1:1.1 to about 1:1.5, depending on the source. Asphaltenes are defined operationally as the n-heptane ($C_7H_{16}$)-insoluble, toluene ($C_6H_5CH_3$)-soluble component of a carbonaceous material such as crude oil, bitumen, or coal. Asphaltenes typically include a distribution of molecular masses in the range of about 400 g/mol to about 1500 g/mol.

As used herein, when the oxygen content of the vaporous effluent is specified, it is to be understood that the oxygen content refers to the volume percent (vol %) of diatomic oxygen, $O_2$. A vapor which is essentially free of oxygen has a diatomic oxygen concentration of less than about 0.1 vol %.

For purposes herein a solid particulate is a solid having a major dimension of less than 10 mm, typically less than 1 mm, and a minor dimension of less than 10 mm, typically less than 1 mm. A particulate "fine" is defined as a solid material having a size and a mass which allows the material to become entrained in a vapor phase of a thermo-desorption process as disclosed herein, e.g., less than 1 micron.

As used herein, "clay" refers to a fine-grained material comprising one or more clay minerals, i.e., a mineral from the kaolin group, smectite group, illite group, or chlorite group, or other clay types having a 2:1 ratio of tetrahedral silicate sheets to octahedral hydroxide sheets. An "acid-treated clay" refers to clay that has been treated by contact with a strong mineral acid to delaminate or "peptize" the clay structure and adsorb the acid onto either or both external and internal surfaces of the clay structure.

As used herein, feldspar minerals refer to tectosilicates including potassium-feldspar (K-spar), albite, anorthite, and various solid solutions between these endmembers. Accordingly, in embodiments, the solid catalyst may include alkali feldspar, barium feldspar, plagioclase (plagioclase feldspar), and the like. Suitable alkali feldspars include orthoclase, sanidine, microcline, anorthoclase, and the like. Suitable plagioclase feldspars include albite, oligoclase, andesine, labradorite, bytownite, anorthite, and the like. Suitable barium feldspars include celsian and hyalophane, and the like.

As used herein, oil contaminated solids may include drill cuttings obtained from drilling or other operations which utilize an oil based treatment fluid, and/or which utilize a treatment fluid comprising oil, or which contain oil e.g., are contaminated with oil, from the drilling operation. The terms "oil based substrate" and "oil bearing substrate" are used interchangeably. Likewise, the terms "oil based drill cuttings" and "oil bearing drill cuttings" are used interchangeably. It is also to be understood that oil "contaminated" solids suitable for use herein may be obtained as a waste product from another operation, or may be intentionally produced by combining known materials prior to treatment to yield the solid catalyst disclosed herein. Accordingly, the term "oil contaminated" refers to the presence of oil, and not to whether or not the substrate is a waste product or is intentionally produced.

The term "catalytic pyrolysis oil product" refers to an oil processed according to embodiments disclosed herein, which has a reduced viscosity relative to the heavy oil it was produced from. As used herein, catalytic pyrolysis oil products produced according to embodiments disclosed herein have an API gravity of greater than about 22.3.

In some embodiments according to the invention, a process comprises feeding to a reactor a feed mixture comprising 100 parts by weight heavy oil (API<22.3), from about 5 to 100 parts by weight water, and from about 1 to 20 parts by weight solid catalyst particulates comprising a mineral support and an oxide or acid addition salt of a Group 3-16 metal; and heating the feed mixture in the reactor at a temperature, pressure, and for a period of time sufficient to produce a pyrolyzate vapor phase at an exit from the reactor condensable to form an oil phase lighter than the heavy oil.

In embodiments, the absolute pressure in the reactor is from below atmospheric or about atmospheric up to about 20 atm, preferably up to about 10 atm, or up to about 5 atm, or up to about 3 atm, or up to about 2 atm, or up to about 1.5 atm (7-8 psig), and the pyrolyzate exits from the reactor at a temperature above 150° C., or above 200° C., or above 400° C., up to about 500° C., or up to about 600° C., or up to about 700° C.

In embodiments, the catalyst particulates comprise particulates recovered from a thermal desorption process in which an oil contaminated substrate comprising a peptizable matrix component selected from acid-reactive clays and minerals, has been contacted with an acidic reagent to form a peptizate, and the peptizate mixed with a combustion effluent gas comprising less than about 1 volume percent oxygen, under turbulent conditions at a temperature above 200° C., to form a light phase comprising desorbed oil and a dense phase from which the catalyst particulates are recovered.

In embodiments, the process further comprises contacting an oil contaminated substrate comprising a peptizable matrix component selected from acid-reactive clays and minerals, with an acidic reagent to form a peptizate; mixing the peptizate with a combustion effluent gas comprising less than about 1 volume percent oxygen, under turbulent conditions at a temperature above 200° C., to form a light phase comprising desorbed oil and a dense phase; recovering solids from the light phase, the dense phase, or a combination thereof; and supplying the recovered solids as the catalyst particulates in the feed mixture fed to the reactor.

In some embodiments, the catalyst particulates or a component thereof have been acid-treated. In some embodiments, the catalyst particulates or a component thereof (which may be the same or different component as the acid-treated component) have been thermally treated at a temperature above 200° C. In some embodiments, the process further comprises contacting a pre-catalyst material with an acidic reagent to acid-treat the pre-catalyst material, and supplying the acid-treated material in the catalyst particulates. In some embodiments, the process further comprises thermally activating a pre-catalyst material (which may be the same (before or after acid activation) or different material as the acid-treated material) at a temperature above 200° C., and supplying the thermally treated material in the catalyst particulates.

In some embodiments, the catalyst particulates comprise calcium sulfate, barium sulfate, calcium carbonate, or a combination thereof.

In some embodiments, the catalyst particulates comprise a feldspar mineral, quartz, or a combination thereof. In some embodiments, the catalyst particulates comprise plagioclase feldspar comprising a molar average albite fraction of at least 0.65 and an overall composition according to the formula $Na_{Ab}Ca_{(1-Ab)}Al_{(1+Ab)}Si_{(3-Ab)}O_8$, wherein Ab is a number from 0.65 to 1.0 representing the average fraction of the albite in the feldpsar.

In some embodiments, the catalyst particulates comprise clay, such as bentonite.

In some embodiments, the metal comprises iron, lead, zinc, or a combination thereof. In some embodiments, the metal comprises a transition metal, such as iron, cobalt, nickel or the like. In some embodiments, the metal comprises iron (III).

In some embodiments, the feed mixture comprises from about 20 to about 50 parts by weight of the water, and from about 5 to about 10 parts by weight of the catalyst particulates.

In some embodiments, the process comprises first mixing the heavy oil and the catalyst particulates, and then mixing the water with the mixture of the heavy oil and catalyst particles to obtain the feed mixture. In some embodiments, the process further comprises passing (e.g., pumping) the feed mixture through a line to the reactor. In some embodiments, the feed mixture comprises an emulsion having an electrical stability of greater than 1600 V, when determined according to API 13B-2 at 130° C. (preferably greater than 1700 V, 1800 V, 1900 V, or 2000 V). In some embodiments, the feed mixture comprises an emulsion having an apparent viscosity at 30° C. and 100 $s^{-1}$ at least 30% lower than the heavy oil alone.

In some embodiments, the heating of the feed mixture comprises passing the feed mixture in heat exchange relationship with a combustion gas, e.g., passing the feed mixture in indirect heat exchange relationship with a heating medium supplied at an inlet temperature from about 600° C. to about 1200° C.; or passing the feed mixture in direct heat exchange relationship with a combustion gas comprising less than about 1 vol % molecular oxygen and having an inlet temperature from about 300° C. to about 1200° C. In some embodiments, the process comprises injecting the feed mixture into the reactor, e.g., using an atomizing nozzle, and in some embodiments the injection is into a stream of combustion flue gases or other hot gas in direct heat exchange to promote rapid heating and mixing, e.g., countercurrently sprayed upstream against an oncoming flow of the combustion gas. In some embodiments, the feed mixture is sprayed downwardly into a reactor for the residue and solids to accumulate in the bottom of the reactor, e.g., injection against an up-flowing hot gas stream such as combustion flue gas, and in some embodiments the accumulated solids are periodically or continuously removed from the reactor.

In some embodiments, the pyrolyzate vapor phase comprises a condensate upon cooling having an overall API gravity greater than 20° or greater than 22.3°. In some embodiments, the process further comprises cooling the pyrolyzate vapor phase to form a condensate, and collecting the condensate, wherein the condensate has an overall API gravity greater than 20° or greater than 22.3°.

In some embodiments, the pyrolyzate vapor phase comprises hydrocarbons in an amount recoverable by condensation at 30° C. of at least about 70 parts (preferably 80 parts, more preferably 90 parts) by weight per 100 parts by weight of the heavy oil in the feed mixture. In some embodiments, the pyrolyzate vapor phase comprises less than 5 vol % of non-condensable (30° C.) hydrocarbon gases based on the total volume of hydrocarbons in the pyrolyzate vapor phase (dry basis).

In some embodiments according to the invention, an apparatus for treating heavy oil comprises a heavy oil (API<22.3, preferably API<20) source; a water source; a catalyst particulate source, wherein the catalyst particulates comprise a mineral support and an oxide or acid addition salt of a Group 3-16 metal; a mixing zone to combine 100 parts by weight of the heavy oil, from about 5 to 100 parts by weight water (preferably 20 to 50 parts by weight water), and from about 1 to 20 parts by weight solid catalyst particulates (preferably 5 to 10 parts by weight solid catalyst particulates) into a feed mixture comprising an emulsion; a transfer line to supply the emulsion from the mixing zone to a pyrolysis zone; a combustion gas source to supply a combustion gas to heat the pyrolysis zone; a control system to maintain the pyrolysis zone at a temperature, pressure and residence time to form a pyrolyzate vapor phase; and a vapor line to receive the pyrolyzate vapor phase from the pyrolysis zone. In some embodiments, the combustion gas comprises less than about 1 vol % molecular oxygen, and/or has a temperature from about 300° C. to about 1200° C.

In some embodiments, the apparatus comprises a nozzle to inject the feed mixture into the pyrolysis zone, e.g., to atomize the feed mixture into the hot combustion gas. In some embodiments, the nozzle is directed against a flow of the combustion gas, e.g., sprayed downwardly against an up-flowing combustion flue gas stream introduced into a lower end of a reactor vessel housing the pyrolysis zone, e.g., through a gas inlet through a side or bottom wall of the reactor. In some embodiments, the apparatus comprises a solids collection zone in or below the pyrolysis zone, e.g., at the bottom of a reactor vessel housing the pyrolysis zone, and may further comprise an outlet for continuous or periodic removal of the solids, e.g., using a rotary valve in the outlet.

In embodiments, the heavy oil comprises heavy crude oil, extra heavy crude oil, tar, sludge, tank bottoms, spent lubrication oils, oil based drill cuttings used motor crankcase oil, oil recovered from oil based drill cuttings, or a combination thereof. In embodiments, the heavy oil has an API gravity of less than 22.3° API or less than 20° API or less than 10° API. In embodiments, the heavy oil has a viscosity of 1000 cP or less, or between 1000 and 10,000 cP, or greater than 10,000 cP, or greater than 20,000 cP, or greater than 30,000 cP, or greater than 40,000 cP, or greater than 50,000 cP.

In embodiments, the heavy oil, may be pretreated or washed prior to processing. In embodiments, the heavy oil may be washed with any combination of water, acids, bases, and/or the like. For example, the heavy oil may be washed with a mineral acid, e.g., contacted with a mineral acid such as sulfuric acid, separated, and then decanted, followed by washing with water, and then subject to treatment according to embodiments disclosed herein. In some embodiments of the invention, the heavy oil that is treated need not be dewatered or desalted and can be used with various levels of aqueous and/or inorganic contaminants. Any water that is present, for example, means that less water needs to be added to form the feed mixture to obtain the desired water: oil ratio. The salts and minerals that may be present in crude oil do not appear to adversely affect results. These embodiments are particularly advantageous in being able to process waste emulsions or emulsions such as rag are difficult to break. Considering that the industry goes to great lengths to break emulsions into clean oil and water phases, feeding such emulsions in the feed mixture herein to the reactor for upgrading can avoid the need to break such emulsions altogether.

In embodiments, the solid catalyst comprises a plurality of solid particulates. In some embodiments, the solid particulates comprise a matrix component selected from acid-reactive clays and minerals and the acid reaction products thereof. In some embodiments the catalyst particulates comprise a mineral support and an oxide or acid addition salt of a Group 3-16 metal, preferably a Group 8-10 metal (formerly Group VIII).

In embodiments, the solid catalyst comprises quartz, feldspar minerals, plagioclase-feldspar minerals, bentonite, barite, or a combination thereof. In embodiments, the solid catalyst comprises albite. Suitable alkali feldspars include orthoclase, sanidine, microcline, anorthoclase, and the like. Suitable plagioclase feldspars include albite, oligoclase, andesine, labradorite, bytownite, anorthite, and the like. Suitable barium feldspars include celsian and hyalophane, and the like.

In embodiments, the solid catalyst may comprise from about 1 ppm to 5 wt % cadmium, chromium, copper, cobalt, iron, lead, molybdenum, nickel, silver, vanadium, zinc, or a combination thereof. In embodiments, the solid catalyst comprises about 1 ppm to 5 wt % of a metal compound according to the formula $MX_b$, wherein M is iron, lead or zinc; each X is independently fluorine, chlorine, bromine, or iodide; and b is 2 or 3; a Lewis acid; a mineral acid, or a combination thereof. In embodiments, the solid catalyst comprises about 1 ppm to 5 wt % of a metal compound according to the formula $MX_b$, wherein M is a Group 8-10 metal such as iron, cobalt or nickel, preferably iron; each X is independently an anionic group such as halide (fluoride, chloride, bromide, or iodide), nitrate, sulfate, acetate, carbonate, citrate, cyanide, nitrite, phosphate or the like, including combinations thereof, and preferably X is chloride, nitrate, sulfate, or a combination thereof, such as chloride and nitrate; and b is 2 or 3, preferably 3.

In embodiments, the solid catalyst comprises quartz or feldspar minerals comprising from about 1 to about 3 wt % iron. In embodiments, the solid catalyst may further comprise halides, e.g., fluorides, bromides, chlorides and/or iodides, and/or the halides present may consist essentially of chlorides.

In embodiments, the solid catalyst is essentially free of cadmium, silver, tin, and/or bismuth. In embodiments, the solid catalyst comprises less than about 10 ppm of cadmium, silver, tin, and/or bismuth, if any is present.

In some embodiments according to the invention, the catalyst and/or a component thereof is prepared according to the process 10 as illustrated in FIG. 1. In process 10, a pre-catalyst material 12 is treated in operation 14, e.g., acid-treated in operation 16 by contact with acidic reagent 18 and/or thermally treated in operation 20 by supply of heat source 22, to obtain a catalyst material 24. The catalyst material 24 may be the catalyst particulates used directly as obtained in any of the pyrolysis embodiments described herein, or may optionally be further processed before used in the pyrolysis embodiments, and/or which may be a catalyst component, such as, for example, the acid treated and/or thermally treated support or metal produced separately and combined in a subsequent step with the other catalyst components.

Acid activation 16 is typically effected by contacting the optionally dried precatalyst material with an acidic reagent, e.g., a mineral acid, to replace at least some of the cations with $H^+$, and optionally washing with water and/or brine to remove excess acidic reagent and/or base addition salts thereof. If desired, the acid-treated material can be thermally processed in operation 20, and/or the thermally treated material can be acid-treated in operation 16 and optionally heat treated again in in a second operation 20.

Thermal activation 20 involves heating the pre-catalyst material above 100° C. at a temperature above 100° C., such as from 150° C. or from 200° C. or from 400° C. up to 600° C. or up to 800° C. or up to 1200° C., e.g., 400° C. to 600° C., for a period of time from less than 1 minute up to 24 hours or more, e.g., 1 to 16 hours. Calcining is an example of thermal activation.

As one example of activation of a clay such as bentonite, the clay is ground, e.g. to pass a 100 or 200 mesh screen, contacted with sulfuric acid, e.g., 5-20 weight percent aqueous sulfuric acid, at acid:clay ratios of, for example, 0.2 to 0.8, at elevated temperatures, for example 90-95° C., for a period of time from less than 1 minute up to 24 hours or more, e.g., 1 to 16 hours, washed with water and/or brine, e.g., 1 M NaCl, to remove excess sulfate ion, e.g., until the washings are free from sulfate, and calcined at a temperature above 100° C., such as from 150° C. or 200° C. up to 800° C. or 1200° C., e.g., 400° C. to 600° C., etc. Sometimes the acid-treated clay may be subjected to a final grinding or similar operation for comminution to the desired catalyst particle size distribution.

If desired, another catalyst component, e.g., an oxide or acid addition salt of a group 3-16 metal, may be supported on the acid-treated clay by contact with the clay before or after calcination, for example. In some embodiments, the oxide or acid addition salt can be made by contacting the metal and/or a material containing the metal with a mineral acid under strong oxidizing conditions, e.g., in the presence of nitric acid or another strong oxidant capable of oxidizing the metal to a high valence state. For example, an iron source such as carbon steel shavings can be contacted with HCl and nitric acid, e.g., aqua regia, to oxidize the elemental iron Fe(III), as well as other metals that may be present, and form the corresponding acid addition salts, e.g., $FeCl_3$ or $FeNO_3$, or $Fe(III)Cl_a(NO_3)_b$ where a+b=3, and/or Fe(III) (ferric) oxides such as $Fe_2O_3$. In other embodiments the iron source can be supplied as a commercially available iron(III) on a clay support, such as bentonite, especially acid-treated bentonite.

As another example, the catalyst support may comprise treated clays such as those described in U.S. Pat. No. 7,481,878, the disclosure of which is fully incorporated by reference herein. In embodiments, the treated clay is formed by admixing a mineral comprising an acid-reactive clay, e.g., an oil contaminated substrate such as drill cuttings, with a mineral acid, usually under high shear conditions to obtain an acidified admixture; admixing the acidified admixture with alkaline earth under high shear conditions or otherwise heating to vaporize volatile contaminants and reaction products and form a solid reaction product of reduced contaminant concentration; heating the solid reaction product to a temperature above 150° C.; and, recovering the treated clay.

In some embodiments of the invention the catalyst used in the emulsion and/or method comprises a metal compound, preferably from about 1 ppm to 5 wt % (based on the weight of the catalyst particulates, on a clay support, preferably bentonite, where the metal compound is according to the formula $MX_b$, wherein M is a Group 8-10 metal such as iron, cobalt or nickel, preferably iron; each X is independently an anionic group such as halide (fluoride, chloride, bromide, or iodide), nitrate, sulfate, acetate, carbonate, citrate, cyanide, nitrite, phosphate or the like, including combinations thereof, and preferably X is chloride, nitrate, sulfate, or a combination thereof, such as chloride and nitrate, chloride and sulfate; and b is 2 or 3, preferably 3. In some embodiments of the invention, the catalyst used in the emulsion and method comprises $Fe(III)Cl_a(NO_3)_b$ supported on clay, especially bentonite, where a+b=3. In some embodiments of the invention, the catalyst used in the process comprises $Fe(III)Cl_a(NO_3)_b(SO_4)_c$, supported on clay, especially bentonite, where a+b+c=3.

As yet another example, the catalyst particulates comprise particulates recovered from a thermal desorption process in which a peptizable matrix component selected from acid-reactive clays and minerals, e.g., an oil contaminated substrate, has been contacted with an acidic reagent to form a peptizate, and the peptizate mixed with a combustion effluent gas, e.g., comprising less than about 1 volume percent oxygen, under turbulent conditions at a temperature above 200° C., to form a light phase comprising desorbed oil and a dense phase from which the catalyst particulates are recovered. In this example, the catalyst may be obtained by a method comprising contacting an oil contaminated substrate comprising a peptizable matrix component selected from acid-reactive clays and minerals, with an acidic reagent to form a peptizate; mixing the peptizate with a combustion effluent gas comprising less than about 1 volume percent oxygen, under turbulent conditions at a temperature above 200° C., to form a light phase comprising desorbed oil and a dense phase; recovering solids from the light phase, the dense phase, or a combination thereof; and supplying the recovered solids as the catalyst particulates in the feed mixture fed to the reactor.

In some embodiments, the solid catalyst is derived from an oil desorption process in which oil based drill cuttings are contacted with a combustion effluent gas under turbulent conditions at a temperature above 200° C. to desorb the oil to produce a dense phase comprising the solid catalyst. In some embodiments, the oil desorption process further comprises contacting the oil based drill cuttings with an acidic reagent at a temperature between about 70° C. and about 105° C. to obtain a peptizate having a pH from about 6 to 8 prior to contacting the oil based drill cuttings with a combustion effluent gas.

In embodiments, the solid catalyst from the thermal desorption process has an oil content less than or equal to about 3 wt %. In embodiments, the solid particulates of the solid catalyst are produced using an average residence time in the thermal desorption vessel of about 10 seconds to 5 minutes and/or in a process wherein the dilute phase exits the thermal desorption vessel at a temperature of at least about 200° C. In embodiments, at least a portion of the solid catalyst is recovered by cyclonic separation of the solid particulate fines of the solid catalyst from the light phase exiting the thermal desorption vessel.

While not wishing to be bound by theory, it is believed that thermo or thermo chemical desorption of oil contaminated substrates (such as oil-bearing drill cuttings) in which the substrate is exposed to the combustion effluent, which may be sub-stoichiometric with respect to oxygen, at high temperatures to remove the oil from the solid matrix, results in catalytic activation of the substrate. Accordingly, thermo chemical desorption processes in which oil is removed from oil-bearing drill cuttings is believed to result in activation of the metals and/or other active sites present therein such that a suitable catalyst is achieved simultaneously with the oil removal (thermal extraction). Such solids are typically disposed of as waste. Accordingly, catalysts suitable for use herein may be obtained with little or even zero cost.

Alternatively (or additionally), the material fed to the peptizer and thence to the desorber unit for activation may be essentially free of oil, e.g., a particulated mineral comprising an acid reactive clay or other mineral, added separately to the peptizer or added to the peptizer with an oil-containing substrate such as oil based drill cuttings. In this case, the desorber is used without actually desorbing oil from the oil-free particles, but the peptizer contacts the precatalyst material with acid, the acid-precatalyst admixture is then mixed with the combustion gas, and the catalyst particulates recovered as described above, e.g., from a dense phase and/or light phase of the combustion gas-particulate mixture.

In some embodiments, the acid-reactive mineral or clay in the thermochemical desorption-type process (with or without adsorbed oil) preferably comprises one or more of the metals for the activation as the metal oxide, e.g., preferably iron, lead, zinc, or the like, especially iron, and including combinations thereof, especially iron. The iron, lead, or zinc, may be present in the mineral (and thus also present in the catalyst particulates), individually in amounts above 500 mg/kg, or above 1000 mg/kg, or above 5,000 mg/kg, or above 10,000 mg/kg, up to 2 weight percent or 5 weight percent or 10 weight percent, based on the total weight of the mineral (or the catalyst particulates); or collectively in amounts above 1000 mg/kg, or above 5000 mg/kg, or above 10,000 mg/kg, or above 20,000 mg/kg, up to 5 weight percent or 10 weight percent or 20 weight percent, based on the total weight of the mineral (or the catalyst particulates).

In some embodiments, the catalyst particulates comprise calcium sulfate, barium sulfate, calcium carbonate, or a combination thereof. These are common drilling fluid constituents and so may be present in the oil-based drill cuttings, or they may be separately added in the acidizing or thermal activation steps to minerals other than drill cuttings. In some embodiments, the mineral may comprise a feldspar mineral, quartz, or a combination thereof, which are geological minerals commonly drilled through to make the substrate particles which then adsorb oil from the oil based drilling fluid. In an embodiment, the catalyst particulates comprise a plagioclase feldspar comprising a molar average albite fraction of at least 0.65 and an overall composition according to the formula $Na_{Ab}Ca_{(1-Ab)}Al_{(1+Ab)}Si_{(3-Ab)}O_8$, wherein Ab is a number from 0.65 to 1.0 representing the average fraction of the albite in the feldpsar.

In some embodiments, the catalyst particulates may comprise a clay such as bentonite, or the acid-treated forms thereof. Clays such as bentonite are likewise common drilling fluid additives which are found in the oil based drill cuttings, and/or they may be separately added in the acidizing or thermal activation steps to minerals other than drill cuttings, and/or they may be used as the support material.

Figure 2:
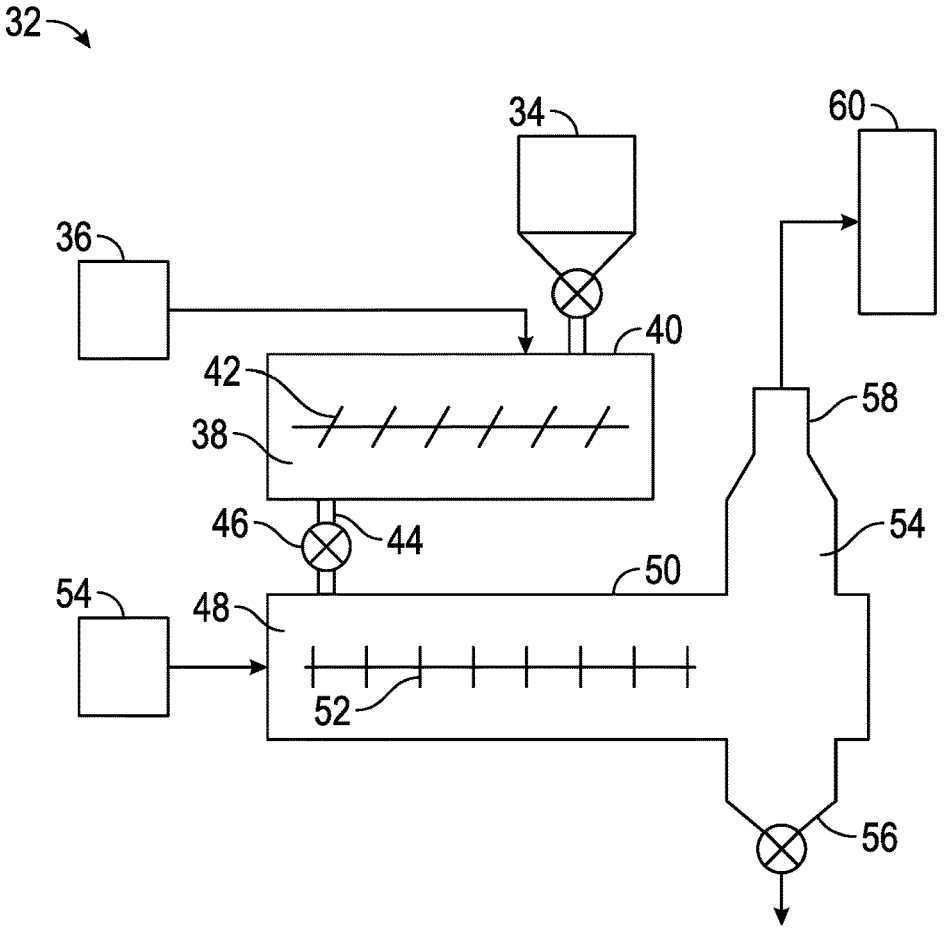
FIG. 2 shows a schematic diagram of another process to produce catalyst according to an embodiment of the invention.

A specific example of a thermo-chemical desorption process or apparatus from which the solid catalyst may be recovered for use herein, is disclosed in my earlier U.S. Pat. Nos. 7,690,445 and/or 8,356,678, the disclosures of which are fully incorporated by reference herein. An exemplary apparatus 32 suitable for producing such catalyst is shown in FIG. 2, wherein the substrate feed zone 34 and acid feed system 36 supply substrate and acid to a peptizer 38 comprising a first housing 40 equipped with one or more high-shear agitators 42. The first housing 40 is preferably fixed and fluidly sealed.

A transfer zone 44, preferably comprising a rotary valve 46 or other means to fluidly isolate the peptizing zone 38, is provided to supply the peptizate to an inlet end of thermal desorption zone 48 within second fixed housing 50 equipped with one or more high-shear agitators 52. Burner 54 is provided to supply hot oxygen lean combustion effluent gas to the thermal desorption zone 48 to fluidize the peptizate and desorb oil from the sorbent material. The second housing 50 is preferably a fixed horizontal cylinder equipped with a solids disengagement zone 54 opposite the inlet end of the thermal desorption zone 48 and a solids outlet 56 adjacent the disengagement zone 54 to receive disengaged solids therefrom.

The solids disengagement zone 54 and solids outlet 56 are preferably spaced away from the agitator 52 to promote solid separation and settling, i.e., the agitator 52 preferably terminates adjacent the solids disengagement zone 54 and does not extend into the solids disengagement zone or above the solids outlet 56. The solids disengagement zone 54 may be provided with a hood 58 or other relatively large cross-sectional and/or low flow velocity plenum to promote solids settling and provide a solids-lean dilute phase for processing in vapor recovery system 60.

In embodiments, the feed mixture supplied to the pyrolysis reactor comprises 100 parts by weight of the heavy oil, from about 5 to 100 parts by weight water, and from about 1 to 20 parts by weight solid catalyst particulates. In embodiments, the feed mixture supplied to the pyrolysis reactor comprises 100 parts by weight of the heavy oil, from about 20 to 50 parts by weight water, and from about 5 to 10 parts by weight solid catalyst particulates.

In some embodiments, the feed mixture has a lower viscosity than the heavy oil at a handling temperature to facilitate handling, pumping, mixing, etc. of the feed mixture. In some embodiments the feed mixture comprises an emulsion having an apparent viscosity at 30° C. and 100 $s^{-1}$ at least 30% lower than the heavy oil alone. In embodiments, the feed mixture has a viscosity of less than or equal to about 50 Pa-s (50,000 cP) at 25° C., or less than or equal to about 40 Pa-s at 25° C., or less than or equal to about 30 Pa-s at 25° C., or less than or equal to about 20 Pa-s at 25° C., or less than or equal to about 19 Pa-s at 25° C., or less than or equal to about 15 Pa-s at 25° C. In embodiments, the viscosity of the feed mixture is less than about 300 mPa-s (300 cP) at 130° C., or less than about 250 mPa-s at 130° C. In embodiments, the feed mixture is pumpable at a temperature between 25° C. and 100° C. Accordingly, the feed mixture may include heavy oil emulsified with water and the solid catalyst to produce a pumpable emulsion which facilitates adequate and uniform injection of the feed mixture into the pyrolysis chamber.

In some embodiments, the feed mixture is a stable emulsion to facilitate transport and storage prior to supply to the pyrolysis reactor, e.g., to inhibit phase separation and solids precipitation, such as a buildup asphaltenes, wax, mineral particles, etc. In some embodiments, the feed mixture comprises an emulsion having an electrical stability (in volts) of greater than 1600 V, when determined according to API 13B-2 at 130° C. In embodiments, the electrical stability (in volts) of the feed mixture emulsion, determined according to API 13B-2 at 130° C., is greater than or equal to about 1600 V, or 1700 V, or 1800 V.

In embodiments, the weight-to-weight ratio of water to heavy oil in the feed mixture is from about 1:20 to about 10:1. In embodiments, water is present in feed mixture at from about 5, or from about 10, or from about 15, up to about 20, or up to about 30, or up to about 40, or up to about 50, or up to about 60 parts by weight water, per 100 parts by weight of the heavy oil present.

The presence of water in the pyrolysis reactor can facilitate the vaporization of hydrocarbons by reducing the partial pressures of the hydrocarbons. Further, it has been discovered that the presence of water can also facilitate the conversion of the heavy oil to an upgraded oil having improved properties as discussed in the examples below. In embodiments, although not wishing to be bound by theory, the amount of water present in the feed mixture is sufficient to promote reaction of the water and/or its atoms with hydrocarbons, catalyst, support, or other compounds present in the pyrolysis reactor, such as, for example, the gas water shift reaction:

$$CO+H_2O \rightleftharpoons CO_2+H_2$$

which may occur simultaneously with the pyrolysis within the pyrolysis chamber, thus providing hydrogen in situ to improve the quality of the catalytic pyrolysis oil product produced by the process. In embodiments, additional water may be added to the pyrolysis chamber to produce additional steam as may be required by downstream processes.

In embodiments, the solid catalyst is present in the feed mixture at greater than about 1 part by weight up to about 20 parts by weight per 100 parts by weight of the heavy oil present. In embodiments, the solid catalyst is present in the feed mixture at greater than about 5 parts by weight, or greater than about 7 parts by weight, per 100 parts by weight of the heavy oil present, up to about 10 parts, or up to about 15 parts, per 100 parts by weight of the heavy oil present, or from about 5 parts by weight up to about 10 parts by weight per 100 parts by weight of heavy oil present in the feed mixture.

In embodiments, the feed mixture further comprises an emulsifying agent such as a surfactant or surfactant system. In embodiments, the feed mixture may further include a mineral acid such as sulfuric acid and/or a salt thereof in addition to the solid catalyst.

In embodiments, the feed mixture is an emulsion formed by combining the heavy oil with water and the solid catalyst and any other components, in the desired proportions. In embodiments, the heavy oil is first combined with the solid catalyst and mixed prior to addition of water or another liquid, since this order of addition can result in a lower emulsion viscosity than other mixing orders. In alternative embodiments, the heavy oil is first combined with water or another liquid (e.g., brine, acidified water, and the like), mixed, and then combined with the solid catalyst and mixed to form an emulsion.

In embodiments, the heavy oil is combined with the water and the solid catalyst to form the feed mixture at a temperature of about 25° C. to about 100° C. In embodiments, the heavy oil is combined with the catalyst system at a temperature of about 30° C. to about 60° C.

Figures 3, 4:
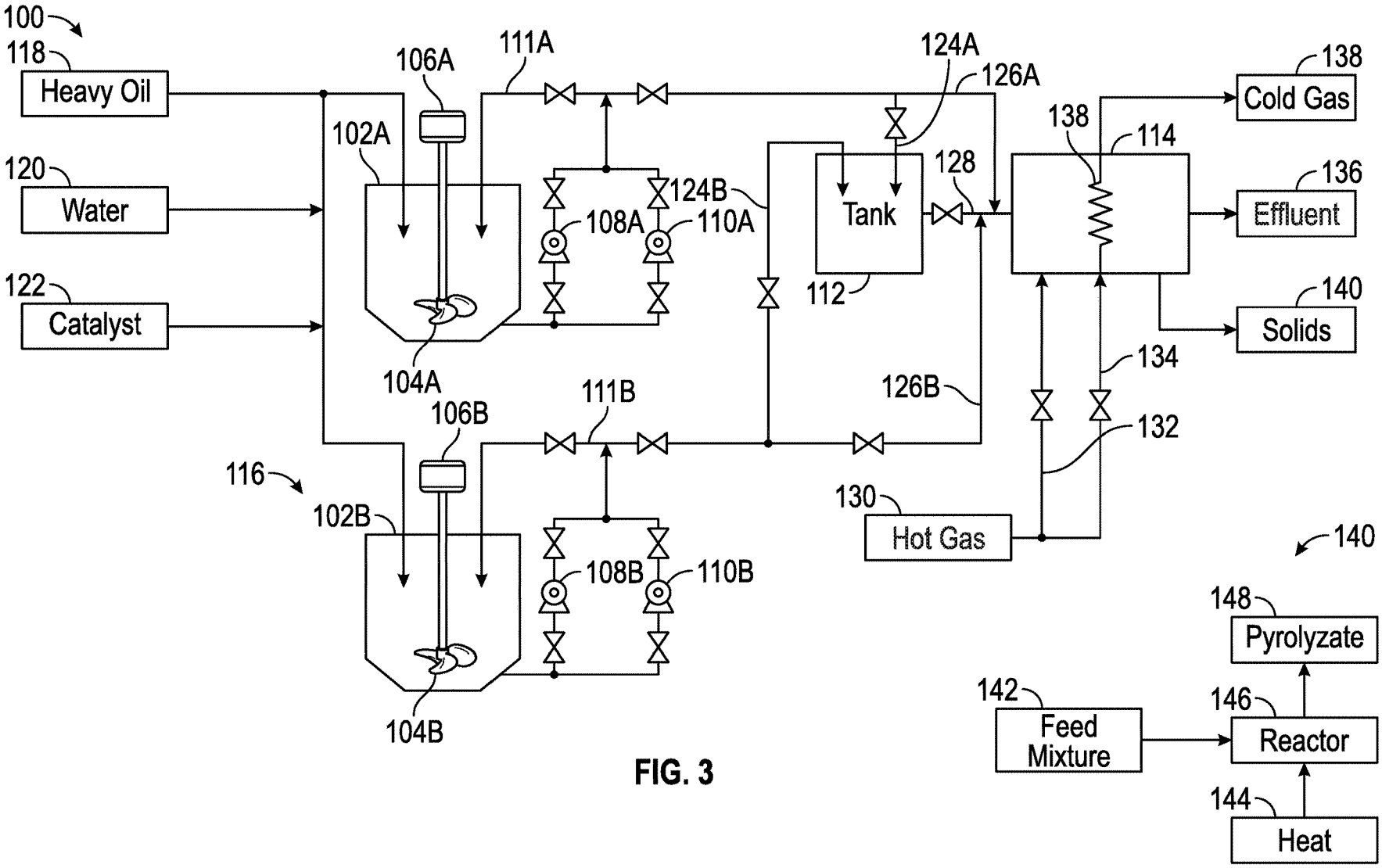
FIG. 3 shows a schematic diagram of a process to produce a feed mixture according to an embodiment of the invention.
FIG. 4 shows a schematic diagram for heavy oil processing according to an embodiment of the invention.

With reference to FIG. 3, an apparatus 100 that may be used to prepare the feed mixture in accordance with some embodiments of the present invention comprises a mixing tank 102A equipped with an agitator 104A, which may be driven by motor 106A. If desired, redundant pumps 108A, 110A can be provided with valved lines for selective recirculation and transfer to an optional holdup tank 112 and/or directly to reactor 114. If desired, a second mixing train 116, including mixing tank 102B, agitator 104B, motor 106B, and pumps 108B, 110B, can be provided to facilitate batch, semi-batch or continuous feed mixture preparation.

In batch operation, heavy oil 118, water 120, and catalyst particulates 122 are charged to the mixing tank 102A (or 102B) in any order, preferably by transferring the heavy oil into the mixing tank, then the catalyst particulates, and then the water while maintaining agitation via agitator 104A (or 104B) and/or providing agitation before and/or after each addition. One of the pumps 108A, 110A (108B, 110B) can recirculate the mixture via valved line 111A (111B) while agitating to facilitate mixing. Once the mixture has been prepared, the pumps 108A, 110A (108B, 110B) can transfer the mixture to holding tank 112 via valved line 124A (124B), or directly to reactor 114 via valved lines 126A (126B) and 128.

If desired, the heavy oil 118 may be heated or mixed with a hydrocarbon diluent to reduce viscosity and facilitate pumping and mixing. The water 120 and/or catalyst particulates 122 may also be optionally heated to facilitate mixing. Also, if desired, the tanks 102A, 102B, 112 and the associated lines and pumps may also be heated to keep the viscosity of the mixture low; however, the mixture in some embodiments has a lower viscosity than the heavy oil 118, so it may be possible to maintain a lower temperature for the mixture or to avoid heating altogether. Furthermore, the mixing operation may be exothermic providing a source of heat in situ for the mixture. Moreover, the emulsion of the feed mixture is stable in some embodiments and so it may be prepared in advance, e.g., up to several days or more, and stored until use without phase separation, before transfer to the tank 112 and/or reactor 114. The emulsion can also be prepared off-site and pumped or trucked to the pyrolysis site. The feed mixture preparation apparatus shown in FIG. 3 may be used in or with any of the embodiments of the invention as shown in FIGS. 4-8.

In some embodiments, the feed mixture may be mixed using an in-line mixer(s) and/or produced in-situ within the pyrolysis chamber (pyrolysis reactor) by adding at least one of the heavy oil, water and/or the solid catalyst directly into the pyrolysis chamber and/or by the addition of water and/or addition of solid catalyst directly to the pyrolysis chamber, depending on the composition of the heavy oil and the end use of the catalytic pyrolysis oil product.

With reference to FIG. 4, one embodiment of the invention provides a system 140 in which the feed mixture 142 described above and heat 144 are supplied to pyrolysis reactor 146, also referred to herein as a pyrolysis chamber, reactor, pyrolysis zone, reaction zone or the like, to provide a pyrolyzate product 148. In some embodiments, the feed mixture 142 is heated in the reactor 146 at a temperature, pressure, and for a period of time sufficient to produce a pyrolyzate vapor phase at an exit from the reactor 146 that is collected in the effluent 148.

In some embodiments, the pyrolyzate vapor phase is condensable to form an oil phase lighter than the heavy oil. In some embodiments the pressure in the reactor is sufficiently low and the temperature sufficiently high such that the pyrolyzate exits the reactor in the vapor phase or primarily in the vapor phase, e.g. with at least 70 wt % of the recovered hydrocarbons, preferably at least 80 wt %, or at least 90 wt %, or at least 95 wt %, or at least 98 wt %, or at least 99 wt % or at least 99.9 wt %, or 100 wt % of the recovered hydrocarbon exit the reactor 146 in the vapor phase, based on the total weight of the recovered hydrocarbons. In general, the pyrolyzate effluent 148 is primarily or mostly mostly gas phase, comprised of hydrocarbons, steam, and in the case of direct heating, flue gases such as carbon dioxide or monoxide, nitrogen, additional steam, etc., but may entrain relatively minor amounts of liquid droplets and/or small-particle solids (fines) that may be removed by filtration, cyclonic separation and/or condensation with the recovered hydrocarbons when they are subsequently condensed to produce the catalytic pyrolysis oil product.

In an embodiment, the absolute pressure in the reactor 146 is from about 1 to 1.5 atm absolute, e.g. from about 1 atm to about 1.5 atm, or to about 1.1 atm, and the pyrolyzate vapor 148 exits from the reactor at a temperature above 200° C., e.g., above 300° C., or from about 300° C. up to about 500° C., or up to about 600° C. or up to about 700° C., or from about 350° C. to about 425° C.

With reference to FIG. 3, the feed mixture from line 128 is heated in the pyrolysis chamber by hot gas 130, e.g., combustion effluent or another gas at a temperature from about 300 C or 600° C. up to about 1200° C., either directly via line 132 or indirectly via line 134. In embodiments the hot gas 130 comprises combustion gas from a fuel-rich combustion, e.g., comprising less than about 1 vol % molecular oxygen, or another effluent having a sufficiently low oxygen content in order to inhibit combustion in the reactor 114. In direct heating, the hot gas 130 having a reactor inlet temperature from about 300° C. to about 1200° C., is contacted or mixed directly with the feed mixture or reaction products thereof, and the hot gas exits the reactor 114 with the pyrolyzate in effluent stream 136. In indirect heating, the hot gas 130, preferably supplied at an inlet temperature from about 600° C. to about 1200° C., enters a heat exchanger 137 within the pyrolysis chamber 114 and cooled gas 138 is collected from an outlet of the heat exchanger. Solids 140 accumulating in the reactor 114 may be periodically or continuously removed for disposal.

Figure 5:
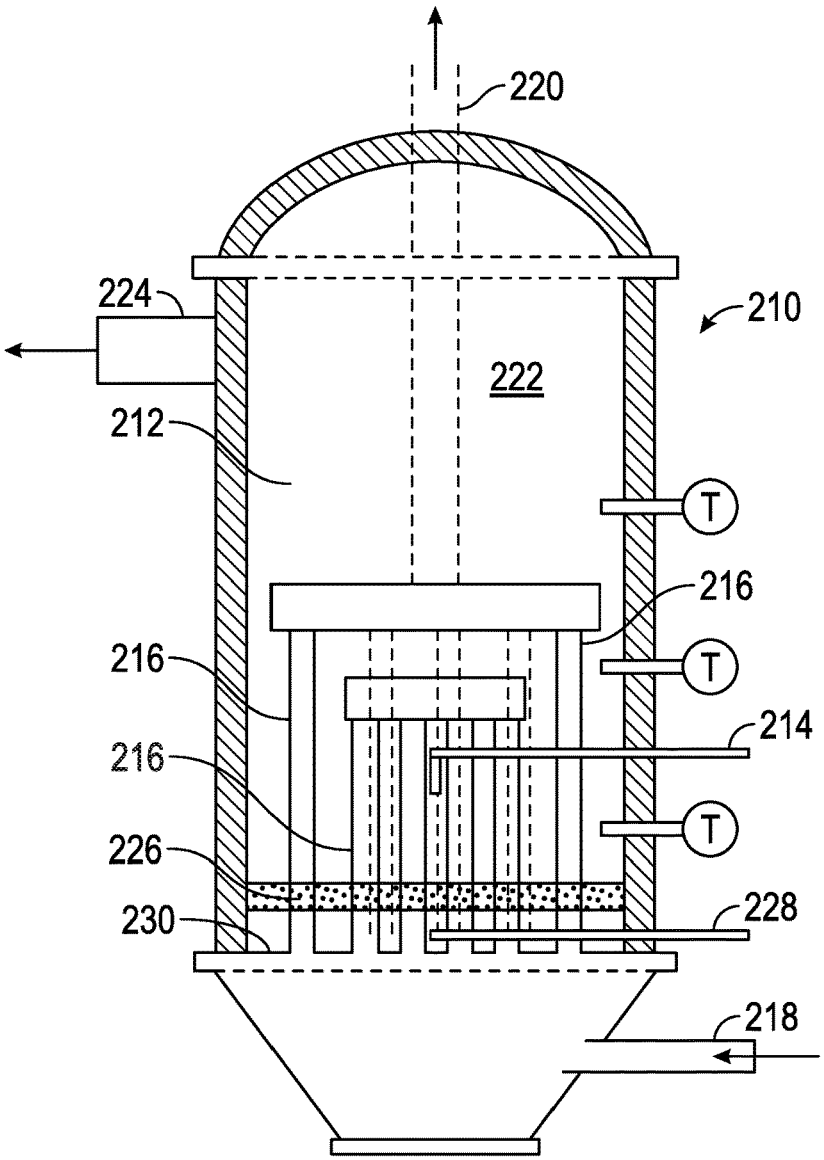
FIG. 5 shows a cross sectional diagram of an indirectly heated pyrolysis reactor according to an embodiment of the invention.
Figure 6:
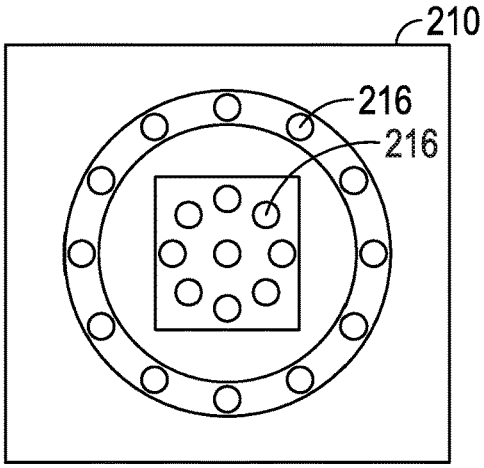
FIG. 6 shows a plan view of the pyrolysis reactor shown in FIG. 5.

With reference to FIGS. 5 and 6 showing embodiments of an indirectly heated pyrolysis reactor 210, the reaction chamber 212 is contained within a process vessel, generally indicated as 10. In embodiments, the feed mixture enters the pyrolysis chamber 212 via an inlet 214. The pyrolysis chamber 212 is indirectly heated via one or more fire tubes 216 or another heat exchanger having a heat transfer surface in the pyrolysis chamber 212. FIG. 6 is a plan view of the reactor 210, which shows an arrangement of the fire tubes 216 in two concentric circles. Hot combustion gases are introduced into the tubes 216 located within the pyrolysis chamber 212 via a gas inlet 218, preferably at a temperature above about 500° C., or above about 600° C. up to about 1200° C., or about 1500° C., or about 2000° C., and vented through a effluent duct 220, preferably at a temperature below about 500° C., or below about 400° C., or below about 300° C. In embodiments, the catalytic pyrolysis product 222 exits the process vessel 210 at a pyrolyzate exit port or duct 224 at a temperature greater than about 150° C., or greater than about 200° C., or greater than about 250° C., or greater than about 300° C., or greater than about 350° C., or greater than about 400° C., or greater than about 450° C. In embodiments, the catalytic pyrolysis product 22 exit the process vessel at a chamber exit 24 at a temperature below about 1000° C., or below about 800° C., or below about 600° C., or below about 500° C.

In embodiments, the pyrolysis chamber or reactor comprises a turbulent environment, and may contain a bed of particulate inert solids 226, which may comprise silica, alumina, sand, or a combination thereof, and/or may include nonvolatile residues from previously treated mixtures such as ash, coke, and/or long chain hydrocarbons (i.e., having 40 carbons or more). These residues may collect and/or may be continuously or periodically removed from the pyrolysis chamber. In embodiments, the feed mixture is fed in the pyrolysis chamber or reactor via inlet 228 at a point below the bed 226, thus fluidizing the bed, and/or the feed mixture may enter just over the bed via inlet 214 onto a downwardly directed impingement plate 230 (fixed or partially fluidized bed) from which the more volatile compounds rise immediately and the less volatile compounds are converted to more volatile compounds in the bed 226.

Figure 7:
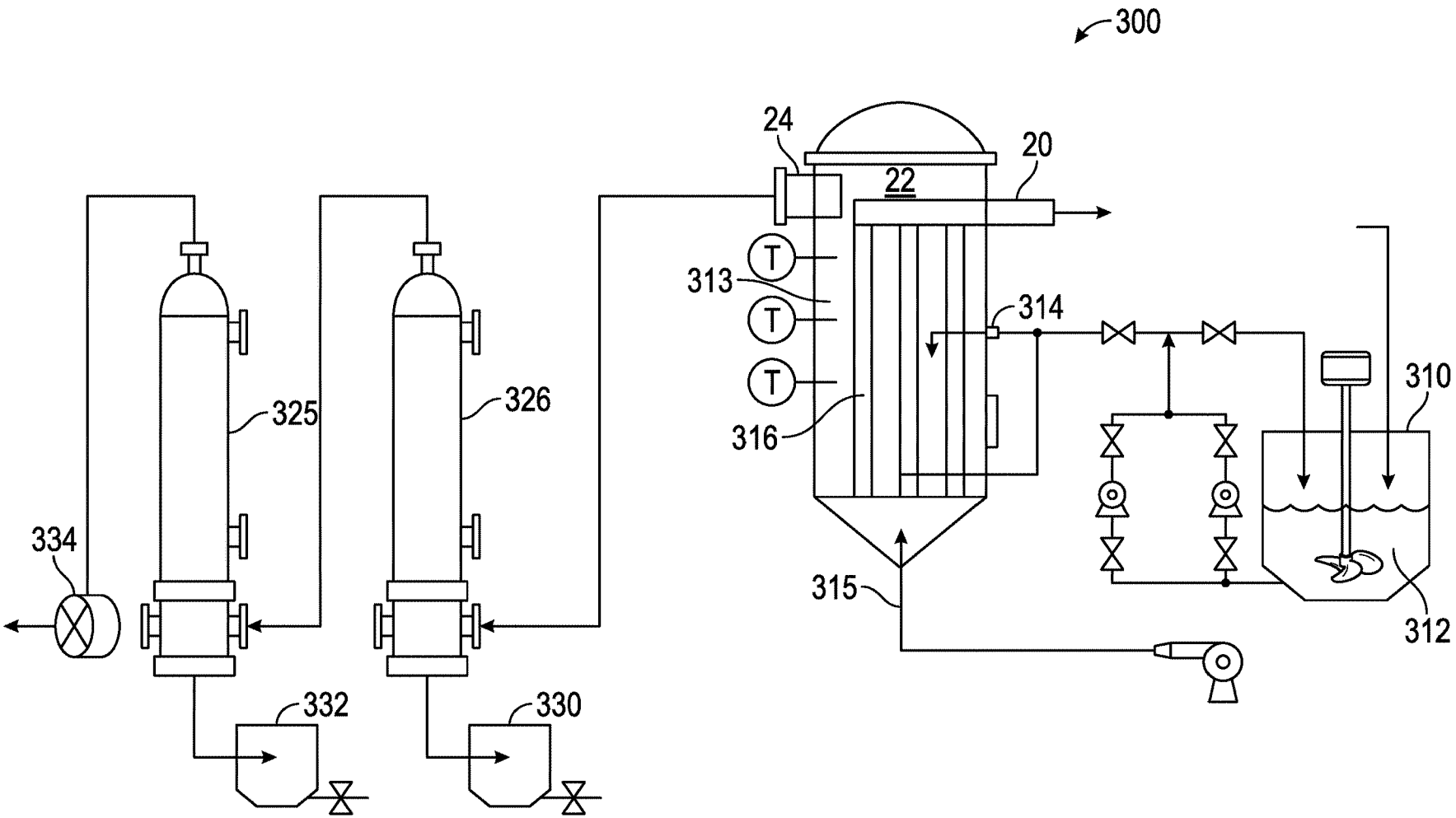
FIG. 7 shows a schematic diagram of another process according to an embodiment of the invention.

As shown in FIG. 7, a process unit according to embodiments, generally represented as 300, may comprise a mixer 310, into which the heavy oil (and/or oil based substrate), water and catalyst are combined to prepare the feed mixture 312, which is then fed into the pyrolysis chamber 313 via feed line 314 which is in indirect thermal contact with combustion gas 315 in fire tubes 316 to produce the vaporous effluent (i.e., the catalytic pyrolysis product 322) which exit the pyrolysis chamber 313 via outlet 324, and which may then be directed into one or more condensers 326 and 328, from which oil and/or water are collected into tanks 330, 332, and/or the vaporous effluent (non-condensable gases) is directed to further processing, for example, via induced draft fan 334. Accordingly, in embodiments, the catalytic pyrolysis product is not directly contacted by the combustion gases within the pyrolysis chamber 313, i.e., the feed mixture and/or the pyrolysis chamber 313 are indirectly heated by the combustion gases 315.

Figure 8:
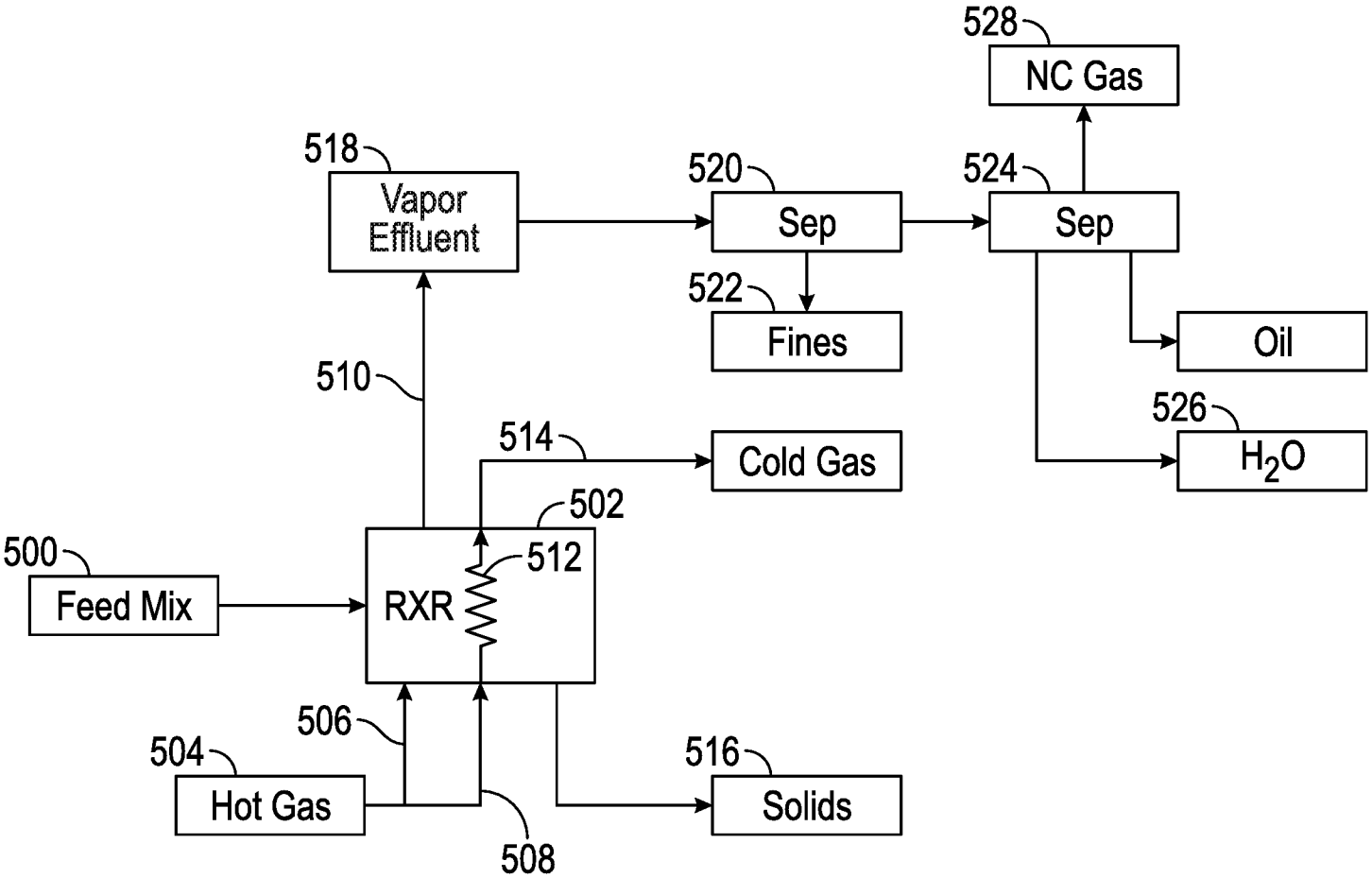
FIG. 8 shows a schematic diagram of a further process according to an embodiment of the invention.

As shown in FIG. 8, in another embodiment, the feed mixture 500 enters the pyrolysis reactor 502 and is heated by hot gas 504 supplied via lines 506 and/or 508 for direct or indirect heating. For direct heating, the hot gas from line 506 is introduced directly into the pyrolysis chamber 502, e.g., at a temperature above about 500° C., or above about 600° C. to about 1500° C., or about 2000° C., and discharged along with the pyrolyzate vapor phase into line 510, e.g., at a temperature below about 700° C., or below about 600° C., or below about 500° C., or below about 400° C., or below about 300° C. For direct heating, the hot gas from line 508 is passed through heat exchanger or coil 512 where it is cooled and then collected in outlet line 514.

In embodiments, the combustion gases utilized as the hot gas 504 in any of the processes disclosed herein, especially in the direct heating embodiments, are sub-stoichiometric with respect to oxygen (oxygen lean/fuel rich) such that the concentration of molecular oxygen $O_2$ in the reactor is less than about 1 vol %, or less than 0.1 vol %, or the combustion gas is essentially free of molecular oxygen. Accordingly, in embodiments, the pyrolysis reactor 502 comprises a reducing atmosphere.

In some embodiments, the reactor 502 is a designed either for direct or indirect heating, but not both, i.e., only one of lines 506 or 508 is provided; in some other embodiments, both lines 506 and 508 may provide for mixed direct/indirect heating by supplying respective portions of the hot gas 504 through each of the lines 506 and 508. In either instance, the reactor 502 in some embodiments provides a turbulent environment in which the feed mixture is at least partially fluidized by steam, pyrolyzate vapor, and/or if direct heating, by the hot gas 504. In some embodiments the solids 516 are continuously or periodically withdrawn from the reactor 502, e.g., by gravity drainage or cyclonic separation. The solids 516 generally comprise the spent or used catalyst particulates, residue from the heavy oil (e.g., asphaltenes, coke, mineral solids, etc.), and may also include generally inert particles such as silica sand that may be optionally added, e.g., to facilitate startup operations.

The vapor effluent 518 from the reactor 502 via line 510 can be processed as desired, e.g., in separator 520 to remove entrained fines 522 and/or in separator 524 to recover water 526 and one or more oil fractions 528, and to exhaust non-condensable gases 530. The separator 520 can comprise a cyclone separator, a filter such as a baghouse, an electric precipitator, etc. Separator 524 can comprise condensers to recover condensate and gravity separation devices, e.g., a centrifuge or oil-water separator tank, to phase separate condensate comprising oil and water mixtures. The non-condensable gases can if desired optionally be further processed for recovery of light hydrocarbons, e.g., methane, ethane and propane, hydrogen, fuel gas, or the like, using a cryogenic process, membrane separators, and so on.

Figure 9:
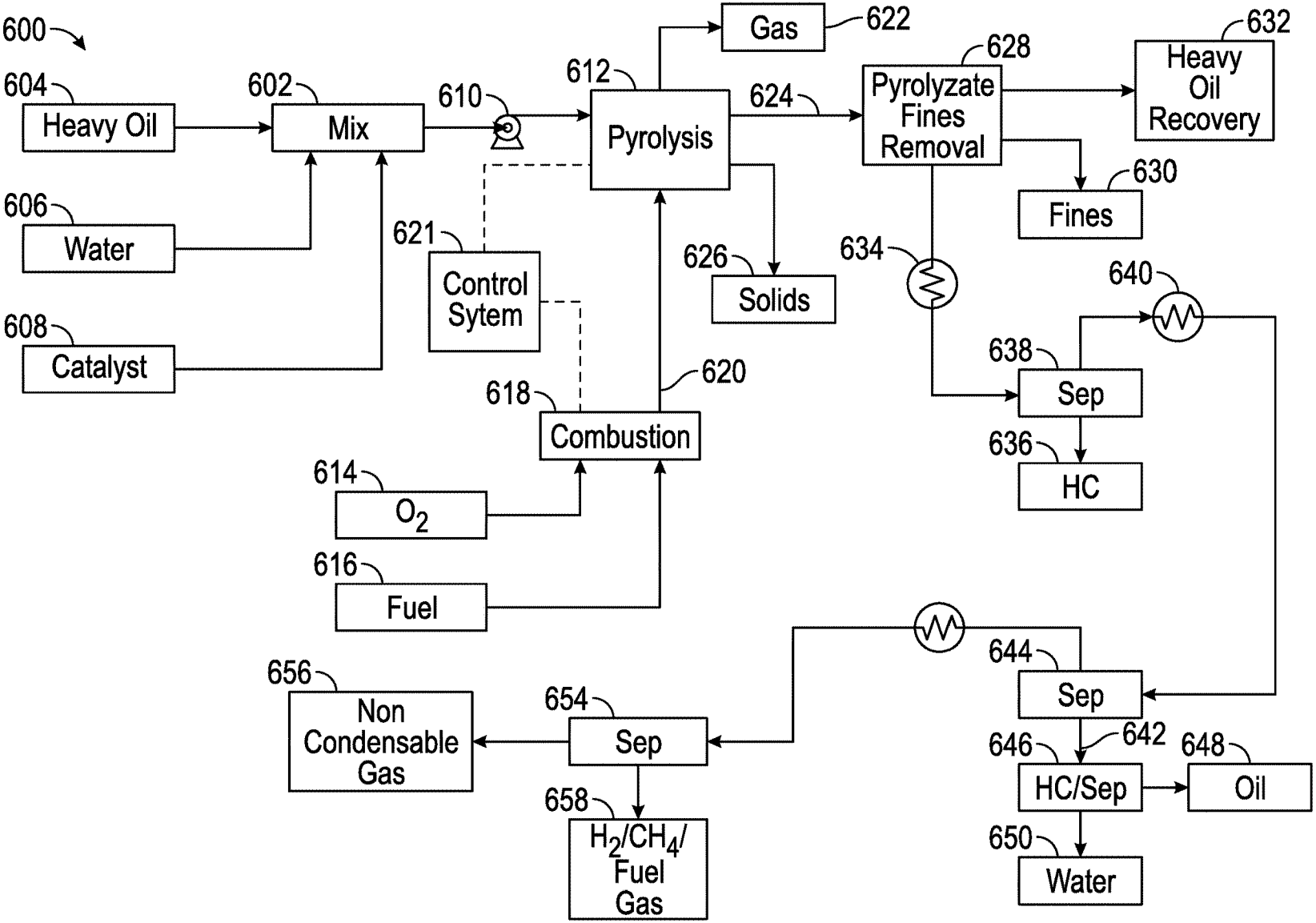
FIG. 9 shows a schematic diagram of yet another process according to an embodiment of the invention.

With reference to FIG. 9, a process 600 according to some embodiments of the present invention comprises a mixer 602 to combine heavy oil 604, water 606, and catalyst particulates 608 into an emulsion as described in reference to FIGS. 3 and 7. The emulsion is transferred via pump 610 to pyrolysis reactor 612. An oxygen source 614 such as air, oxygen or oxygen-enriched air is combined with fuel 616 in combustion burner 618 to supply combustion effluent in line 620 to the reactor 612, as described herein with reference to FIGS. 4-8. Control system 621 is provided to control the operating conditions of the reactor 612, e.g., by manipulation or adjustment of the feed rate(s) and/or combustion rates to maintain the pyrolysis zone at a temperature, pressure and residence time to form a pyrolyzate vapor phase. In the case of indirect heating, cold gas 622 is recovered; otherwise the combustion gases are mixed with the steam and pyrolyzate vapors and recovered in effluent line 624. Solids 626 are recovered from the reactor 612 continuously or periodically.

The effluent from line 624 is processed in fines removal unit 628, to separate fines 630, including any liquid droplets or other solids, and the remaining vapor can be supplied directly to a heavy oil recovery process 632 (see FIG. 11), or after conditioning to remove any undesirable components, supplement any additional components needed, compress to injection pressure, heating to the desired injection temperature, and/or cooling to recover waste heat.

Alternatively or additionally, the remaining vapor can be cooled in exchanger 634 and hydrocarbon condensate 636 recovered from separator 638. The process temperature in the exchanger 634 and separator 638 is preferably above the water dew point so that the condensate 636 is essentially free of water, e.g., less than 1 wt %. The vapors from separator 638 are then cooled in exchanger 640 and condensate 642 recovered from separator 644. The process temperature in the exchanger 6640 and separator 644 is preferably below the water dew point so that the condensate 642 is a mixture of water and oil, which can be further separated in separator 646, which can be a centrifuge or gravity settling tank, for example, to obtain respective oil product and water streams 648 and 650. The overhead vapor from the separator 644 comprising non-condensable gases can be exhausted and/or used as a fuel gas, or it can optionally be further processed in exchanger 652 for cooling and separated in separator 654 into non-condensable gases 656 and or product 658 comprised of one or more streams of hydrogen, methane, ethane, ethylene, propane, propylene, carbon dioxide, fuel gas, including combinations thereof. The separator 654 can be any one or suitable combination of a cryogenic separator, membrane separator, fractionator, solvent extraction, pressure swing absorption, or the like.

Figure 10:
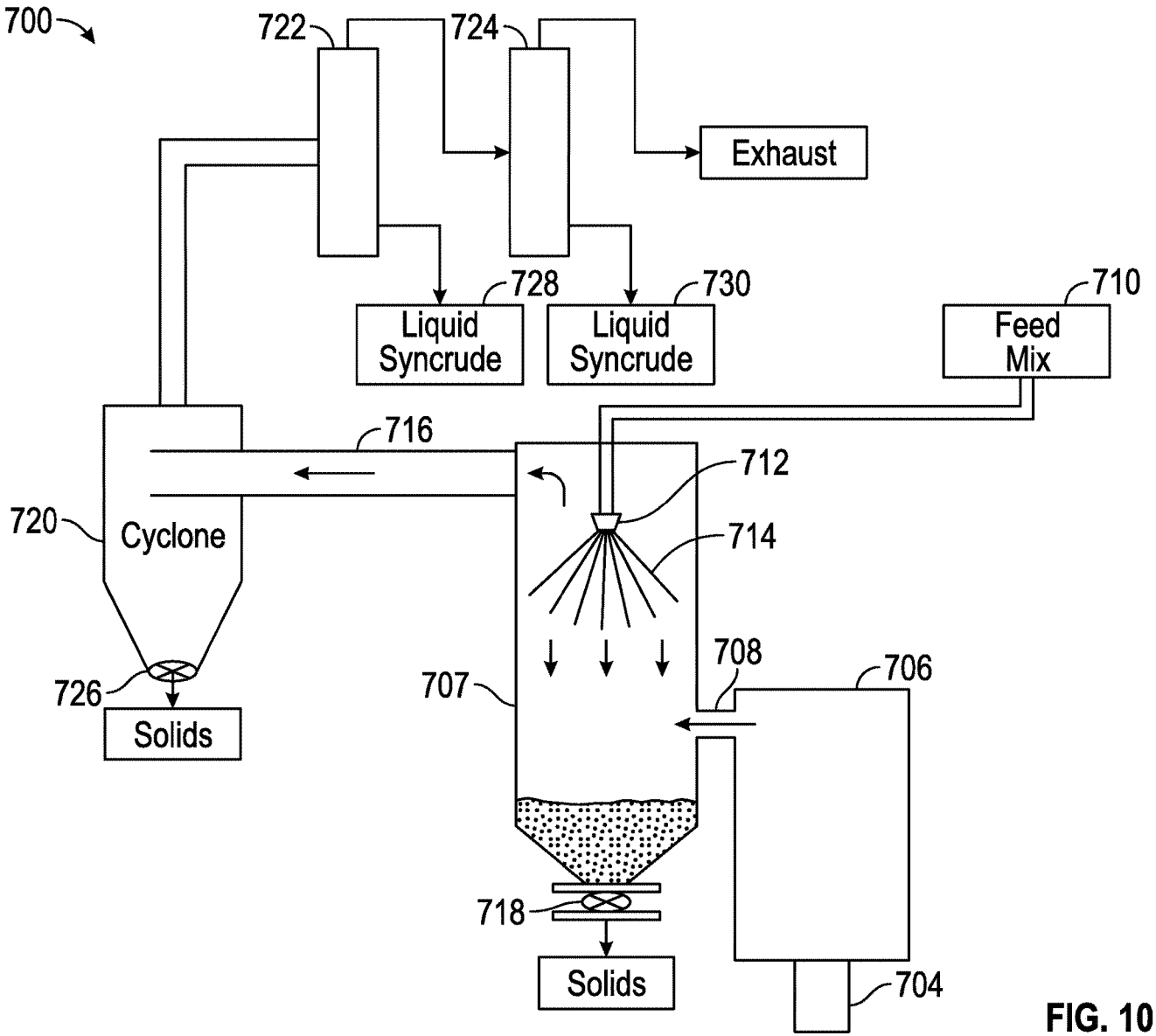
FIG. 10 shows a schematic diagram of another process wherein the feed mixture is heated directly with combustion flue gases according to embodiments of the present invention.

With reference to FIG. 10, a process 700 comprises a reactor 702 that is directly heated by combustion gases supplied from burner 704 in combustion chamber 706 through duct 708. Feed mixture 710 can be prepared, for example, as described herein with reference to FIGS. 1, 3, and 7. The feed mixture 710 is supplied to nozzle 712 and forms a conical spray pattern 714 in the reactor 702.

The nozzle 712 is directed downwardly and can be positioned near the upper end of the reactor, e.g., ⅓ of the way down from the top of the reactor toward the bottom. The nozzle 712 is preferably designed and positioned so that the spray pattern 714 avoids excessive impingement on the inside surfaces of the reactor 702 that can lead to caking and/or buildup of solids on the walls. The feed mixture 710 is thus introduced countercurrently with respect to the flue gas to promote mixing and rapid heating to facilitate the conversion and volatilization of hydrocarbons.

The pyrolyzate vapor phase exits the reactor 702 together with the combustion gas and steam from the feed mixture water into duct 716. The upward flow rate of the gases in the reactor 702 in some embodiments is sufficiently low to avoid excessive entrainment of solid particulates. The solid particulates fall to the bottom of the reactor 702 and can be periodically and/or continuously withdrawn, e.g., via rotary valve 718, for disposal.

The gases from the reactor 702 in some embodiments are passed into cyclone 720 for removal of fines. Fines can be periodically and/or continuously withdrawn from the cyclone 720, e.g., via rotary valve 726. The solids-lean gases in some embodiments are then passed through condensers 722 and 724. The first condenser 722 preferably condenses hydrocarbons, which have a relatively higher boiling point than water, at a temperature above the water dew point so that the condensed liquid syncrude 728 has a low water content, e.g., essentially free of water so that water separation is not needed. The second condenser 724 preferably condenses the hydrocarbons and water and the liquid syncrude 730 that is collected may be processed, if desired, to separate an oil phase from a water phase, e.g., by gravity settling, centrifuge, or the like. The recovered water in this and any of the other embodiments illustrated herein can, if desired, be recycled for preparation of the feed mixture. Noncondensable gases are recovered overhead from the condenser 724.

In embodiments, the pyrolysis chamber or reactor comprises a turbulent environment. In embodiments, the pyrolysis chamber or reactor comprises less than about 1 vol % oxygen, or less than about 0.1 vol % oxygen, if any is present at all. Accordingly, in embodiments, the vaporous effluent comprises less than or equal to about 1 vol % oxygen (i.e., diatomic oxygen), or less than about 0.1 vol % oxygen, or is essentially free of oxygen.

In embodiments, the vaporous effluent comprises less than or equal to about 98 wt %, or 95 wt %, or 90 wt %, or 80 wt % of the water originally present in the feed mixture, and/or greater than 70 wt % of the oil originally present in the feed mixture and/or which is added to the process. Accordingly, water is consumed in these embodiments of the process.

In embodiments, the vaporous effluent of the indirectly heated pyrolysis reactor comprising the catalytic pyrolysis product comprises less than 10 wt %, or less than 5 wt %, or is essentially free, i.e., contains less than 1 wt %, of non-condensable gas, for example, diatomic nitrogen, $C_1$-$C_4$ hydrocarbons, oxygen, and the like. In embodiments, the vaporous effluent of the directly heated pyrolysis reactor comprising the catalytic pyrolysis product and the combustion gases or other heating gas, comprises less than 10 wt %, or less than 5 wt %, or is essentially free, i.e., contains less than 1 wt %, of non-condensable gas selected from $C_1$-$C_4$ hydrocarbons. Preferably less than 5 wt %, or less than 4 wt % or less than 3 wt % or less than 2 wt % or less than 1 wt % of the heavy oil is converted into $C_1$-$C_4$ hydrocarbons, Catalytic pyrolysis according to embodiments disclosed herein provides for greatly reduced energy requirements and produces catalytic pyrolysis oil products having superior properties relative to other methods of crude oil production. In addition, residual heat can also be utilized by solvent/heat flooding at the formation to achieve increased production and superior quality aspects unrealized in other forms of oil production.

While not wishing to be bound by theory, it is believed that the relatively low temperatures and low pressures of embodiments disclosed herein achieve a reduction in the long chain carbon compounds while minimizing and/or avoiding the formation of various non-condensable gaseous products (i.e., $C_1$-$C_4$) and impurities such as sulfur and nitrogen compounds commonly found in the product of pyrolysis processes known in the art.

Catalytic pyrolysis oil products obtained when a heavy oil is processed according to embodiments disclosed herein include various mid- or medium fractions having from about 12 to about 30 carbons, and various light oil fractions having from about 6 to 12 carbons.

In embodiments, the mass of the catalytic pyrolysis oil product recovered from the process is greater than about 50 wt % of the mass of the oil originally present in the feed mixture. In embodiments, the amount of catalytic pyrolysis oil product recovered from the process is greater than or equal to about 60 wt %, or 70 wt %, or 80 wt %, or 90 wt %, or 95 wt % of the mass of the heavy oil originally present in the feed mixture. In embodiments, the catalytic pyrolysis oil product recovered from (produced by) the process has a low organic nitrogen content, (i.e., less than about 1 wt %) and/or low organic or elemental sulfur content (i.e., less than about 1 wt %).

In embodiments, the heavy oil has an API gravity of less than 22.3° or less than 20°, and the catalytic pyrolysis oil product has an API gravity of greater than 22.3° or greater than 20°, respectively. In embodiments, the catalytic pyrolysis oil product may be characterized by asphaltenes having a higher solubility in the catalytic pyrolysis oil product than in the heavy oil at the same temperature.

In embodiments, asphaltenes have a higher solubility in the catalytic pyrolysis oil product recovered from (produced by) the process compared to the solubility of asphaltenes in the heavy oil present in the feed mixture. In embodiments, asphaltenes are at least 2 wt % or 5 wt %, or 7 wt %, or 10 wt % more soluble in the catalytic pyrolysis oil product recovered from (produced by) the process compared to the solubility of the same asphaltenes in the heavy oil originally present in the feed mixture. This allows the catalytic pyrolysis oil product to be used as a diluent with heavy oil, e.g., from 5 to 100 parts by weight pyrolysis oil to 100 parts by weight heavy oil, to transport the heavy oil without requiring heating, or requiring a lesser degree of heating than otherwise required, to maintain flowability of the heavy oil.

The catalytic pyrolysis oil product produced by the instant process may be characterized relative to the heavy oil by a transformation of heavy oils into mid and light crude oils due, at least in part, to the availability of free $H_2$ and/or CO in the presence of the solid catalyst during the pyrolysis. It is believed that the $H_2$ and/or CO reacts with electron deficient carbons produced in the pyrolysis chamber when aromatic rings and/or bonds present in heterocyclic moieties dissociate during pyrolysis.

Accordingly, it is believed that the excellent results achieved by the instant process are due to a pyrolysis process simultaneously conducted with a catalytic process. These combined processes utilize a combination of the gas water shift reaction, hydrocarbon pyrolysis, and/or decomposition of water molecules induced by the temperature and promoted by the catalyst system to obtain the catalytic pyrolysis oil products, which are mainly comprised of aliphatic compounds, low carbon aromatic compounds, and paraffinic compounds, and which have a substantial reduction of heteroatoms e.g., nitrogen and sulfur, relative to the heavy oil utilized as the starting materials. As a result, the catalytic pyrolysis oil products produced according to some embodiments of the instant disclosure comprise a high, nearly aliphatic stoichiometric ratio of H to C, and further comprise a substantial viscosity reduction relative to the heavy oil present in the feed mixture.

Figure 11:
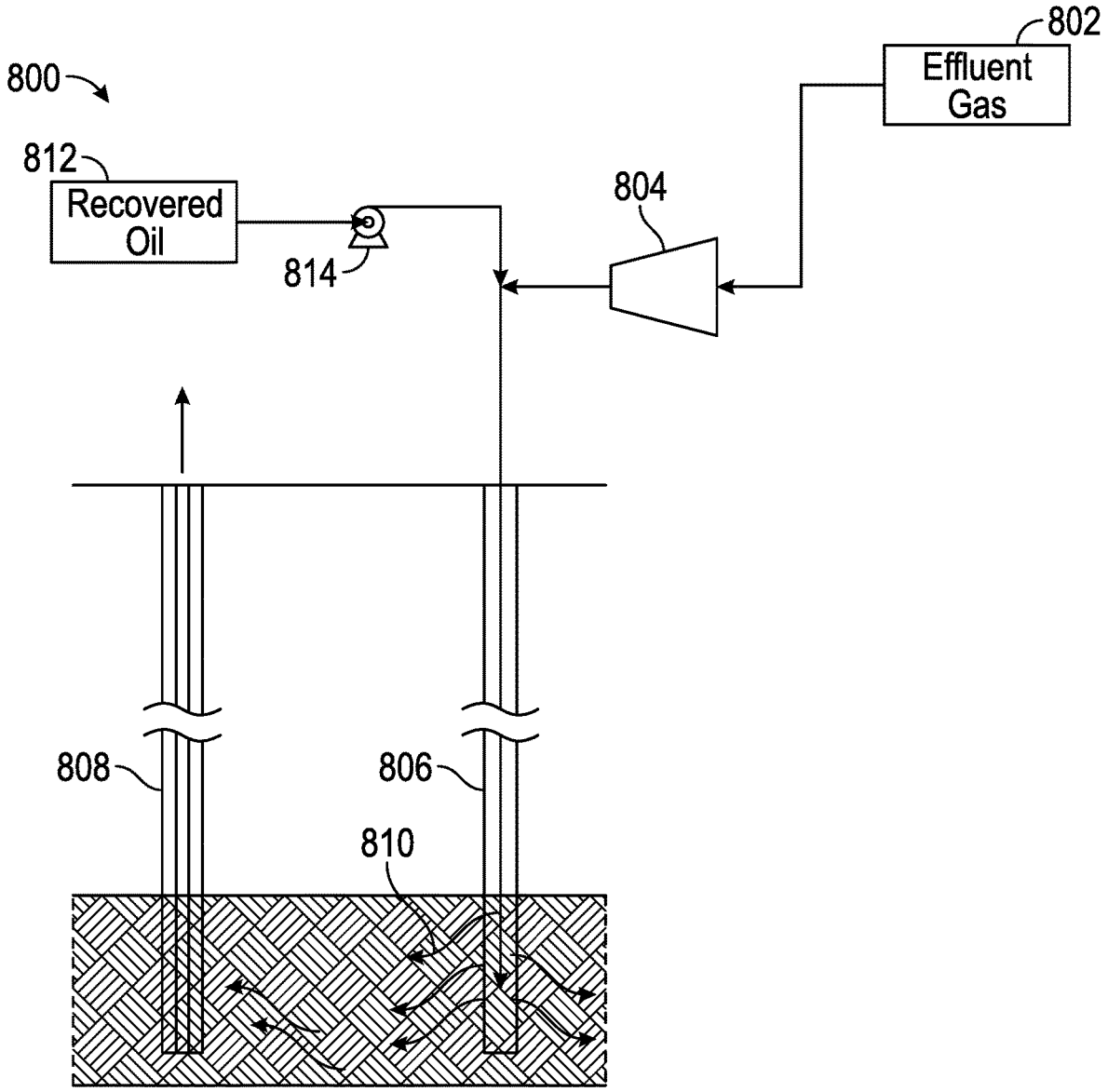
FIG. 11 shows a flow diagram of an oil recovery process according to an embodiment.

With reference to FIG. 11, in embodiments according to the invention, the effluent gas 802 from any one of the pyrolysis reactors described herein (cf. FIGS. 4-10), e.g., the pyrolyzate vapor phase, optionally including steam and/or combustion gases and/or noncondensable gases, especially steam one or both of carbon dioxide and noncondensable hydrocarbons, may be pressurized to injection pressure in compressor 804. In a particular embodiment, the fines may be removed before compression, as shown in FIG. 9, for example. The pressurized treatment fluid is then injected into injection well 806 proximate to a production well 808, at a temperature, a pressure, and in an amount sufficient to produce a flow of hydrocarbons 810 toward the production well 808. In an additional or alternative embodiment, the recovered oil 812 from any one of the pyrolysis reactors described herein (cf. FIGS. 4-10), may be pressurized to injection pressure in pump 814.

The effluent gas 802 and/or recovered oil 812, or a component thereof, may be used as a solvent, viscosity modifier, source of heat, steam, carbon dioxide, noncondensable gas, or the like, in a heavy oil recovery procedure such as, for example, steam or hot water flood, solvent flood (including flooding with a combination of solvent and one or more of steam, water, carbon dioxide, noncondensable gas, etc.), cyclic solvent injection (CSI), vapor extraction (VAPEX), cyclic production with continuous solvent injection (CPCSI), or the like.

LISTING OF EMBODIMENTS

Accordingly, the invention provides the following embodiments:

E1. A process comprising: feeding to a reactor a feed mixture comprising 100 parts by weight oil, preferably heavy oil (API<22.3, PREFERABLY API<20)), from about 5 to 100 parts by weight water, and from about 1 to 20 parts by weight solid catalyst particulates comprising a mineral support, preferably an acid-reactive mineral or clay, and an oxide or acid addition salt of a Group 3-16 metal; and heating the feed mixture in the reactor at a temperature, pressure, and for a period of time sufficient to produce a pyrolyzate vapor phase at an exit from the reactor condensable to form an oil phase lighter than the feed mixture oil.

E2. The process of Embodiment 1 wherein the absolute pressure in the reactor is from about 1 to 1.5 atm.

E3. The process of Embodiment 1, wherein the pyrolyzate vapor phase exits from the reactor at a temperature above 200° C.

E4. The process of Embodiment 1 wherein the absolute pressure in the reactor is from about 1 to 1.5 atm and the pyrolyzate vapor phase exits from the reactor at a temperature above 200° C.

E5. The process of any one of Embodiments E1-E4 wherein the pyrolyzate vapor phase exits from the reactor at a temperature above 300° C.

E6. The process of any one of Embodiments E1-E5 wherein the pyrolyzate vapor phase exits from the reactor at a temperature from about 300° C. to about 500° C.

E7. The process of any one of Embodiments E1-E6 wherein the catalyst particulates comprise particulates recovered from a thermal desorption process in which an oil contaminated substrate, comprising a peptizable matrix component selected from acid-reactive clays and minerals, has been contacted with an acidic reagent to form a peptizate, and the peptizate mixed with a combustion effluent gas comprising less than about 1 volume percent oxygen, under turbulent conditions at a temperature above 200° C., to form a light phase comprising desorbed oil and a dense phase from which the catalyst particulates are recovered.

E8. The process of any one of Embodiments E1-E7 further comprising: contacting an oil contaminated substrate comprising a peptizable matrix component selected from acid-reactive clays and minerals, with an acidic reagent to form a peptizate; mixing the peptizate with a combustion effluent gas comprising less than about 1 volume percent oxygen, under turbulent conditions at a temperature above 200° C., to form a light phase comprising desorbed oil and a dense phase; recovering solids from the light phase, the dense phase, or a combination thereof; and supplying the recovered solids as the catalyst particulates in the feed mixture fed to the reactor.

E9. The process of any one of Embodiments E1-E8 wherein the catalyst particulates or a component thereof, especially clay, have been acid-treated.

E10. The process of any one of Embodiments E1-E9 wherein the catalyst particulates or a component thereof (which may be the same or different component as any acid-treated component) have been thermally treated at a temperature above 200° C.

E11. The process of any one of Embodiments E1-E10 further comprising contacting a pre-catalyst material, preferably clay, with an acidic reagent to acid-treat the pre-catalyst material, and supplying the acid-treated material in the catalyst particulates.

E12. The process of any one of Embodiments E1-E11 further comprising thermally activating a pre-catalyst material (which may be the same (before or after acid activation) or different material as any acid-treated material) at a temperature above 200° C., and supplying the thermally treated material in the catalyst particulates.

E13. The process of any one of Embodiments E1-E12 wherein the catalyst particulates comprise calcium sulfate, barium sulfate, calcium carbonate, or a combination thereof.

E14. The process of any one of Embodiments E1-E13 wherein the catalyst particulates comprise a feldspar mineral, quartz, or a combination thereof.

E15. The process of any one of Embodiments E1-E14 wherein the catalyst particulates comprise plagioclase feldspar comprising a molar average albite fraction of at least 0.65 and an overall composition according to the formula $Na_{Ab}Ca_{(1-Ab)}Al_{(1+Ab)}Si_{(3-Ab)}O_8$, wherein Ab is a number from 0.65 to 1.0 representing the average fraction of the albite in the feldpsar.

E16. The process of any one of Embodiments E1-E15 wherein the catalyst particulates comprise clay.

E17. The process of any one of Embodiments E1-E16 wherein the catalyst particulates comprise bentonite.

E18. The process of any one of Embodiments E1-E17 wherein the metal comprises iron, lead, zinc, or a combination thereof.

E19. The process of any one of Embodiments E1-E18 wherein the metal comprises a transition metal.

E20. The process of any one of Embodiments E1-E19 wherein the metal comprises iron, nickel, cobalt, or a combination thereof.

E21. The process of any one of Embodiments E1-E20 wherein the metal comprises iron (III), preferably $FeCl_3$.

E22. The process of any one of Embodiments E1-E21 wherein the feed mixture comprises from about 20 to about 50 parts by weight of the water.

E23. The process of any one of Embodiments E1-E22 wherein the feed mixture comprises from about 5 to about 10 parts by weight of the catalyst particulates.

E24. The process of any one of Embodiments E1-E23 wherein the feed mixture comprises from about 20 to about 50 parts by weight of the water, and from about 5 to about 10 parts by weight of the catalyst particulates.

E25. The process of any one of Embodiments E1-E24 further comprising first mixing the feed (heavy) oil and the catalyst particulates, and then mixing the water with the mixture of the feed (heavy) oil and catalyst particles to obtain the feed mixture.

E26. The process of any one of Embodiments E1-E25 further comprising passing (e.g., pumping) the feed mixture through a line to the reactor.

E27. The process of any one of Embodiments E1-E26 wherein the feed mixture comprises an emulsion having an electrical stability of greater than 1600 V, when determined according to API 13B-2 at 130° C.

E28. The process of any one of Embodiments E1-E27 wherein the feed mixture comprises an emulsion having an apparent viscosity at 30° C. and 100 $s^{-1}$ at least 30% lower than the feed mixture (heavy) oil alone.

E29. The process of any one of Embodiments E1-E28 wherein the feed mixture heating comprises passing the feed mixture in heat exchange relationship with a combustion gas.

E30. The process of any one of Embodiments E1-E29 wherein the feed mixture heating comprises passing the feed mixture in indirect heat exchange relationship with a heating medium supplied at an inlet temperature from about 600° C. to about 1200° C.

E31. The process of any one of Embodiments E1-E30 wherein the feed mixture heating comprises passing the feed mixture in direct heat exchange relationship with a combustion gas comprising less than about 1 vol % molecular oxygen and having an inlet temperature from about 300° C. to about 1200° C.

E32. The process of any one of Embodiments E1-E31 wherein the feed mixture oil has an API gravity less than 22.3° and the pyrolyzate vapor phase comprises a condensate upon cooling having an overall API gravity higher than 22.3°.

E33. The process of any one of Embodiments E1-E32 further comprising cooling the pyrolyzate vapor phase to form a condensate, and collecting the condensate, wherein the condensate has an overall API gravity greater than 22.3°.

E34. The process of any one of Embodiments E1-E32 wherein asphaltenes from the feed mixture (heavy) oil have a higher solubility at a temperature of 30° C. in hydrocarbons condensed from the pyrolyzate relative to the heavy oil.

E35. The process of any one of Embodiments E1-E34 wherein the pyrolyzate vapor phase comprises hydrocarbons in an amount recoverable by condensation at 30° C. of at least about 70 parts (preferably 80 parts, more preferably 90 parts) by weight per 100 parts by weight of the feed mixture (heavy) oil.

E36. The process of any one of Embodiments E1-E35 wherein the pyrolyzate vapor phase comprises less than 5 vol % of non-condensable (30° C.) hydrocarbon gases based on the total volume of hydrocarbons in the pyrolyzate vapor phase (dry basis).

E37. A process comprising: preparing catalyst particulates comprising a mineral support and an oxide or acid addition salt of a Group 3-16 metal, the preparation comprising contacting a first pre-catalyst material with an acidic reagent to acid-treat the pre-catalyst material, and thermally activating at a temperature above 200° C. a second pre-catalyst material, which may be the same as the first pre-catalyst material before or after the acid activation, or which a different material from the first acid-treated material, and if the first and second pre-catalyst materials are different, combining the first and second pre-catalyst materials, to form the catalyst particulates; feeding to a reactor a feed mixture comprising 100 parts by weight oil, preferably heavy oil (API<22.3, preferably API<20)), from about 5 to 100 parts by weight water, and from about 1 to 20 parts by weight solid catalyst particulates comprising a mineral support and an oxide or acid addition salt of a Group 3-16 metal; and heating the feed mixture in the reactor at a temperature, pressure, and for a period of time sufficient to produce a pyrolyzate vapor phase at an exit from the reactor condensable to form an oil phase lighter than the feed mixture oil.

E38. The pyrolyzate vapor phase produced according to the process of any one of Embodiments E1-E37.

E39. The pyrolyzate vapor phase condensate produced according to the process of any one of Embodiments E1-E39.

E40. An oil produced by heating a feed mixture comprising a heavy oil and a catalyst system comprising water and a solid catalyst, in a pyrolysis chamber at a pressure from about 1 to 1.5 atm for a period of time sufficient to form a vaporous effluent at a temperature from about 300° C. to about 500° C. comprising a catalytic pyrolysis product oil and steam; and condensing the vaporous effluent to recover the catalytic pyrolysis product oil.

E41. An apparatus for treating heavy oil comprising: an oil source, preferably a heavy oil (API<22.3, preferably API<20)) source; a water source; a catalyst particulate source, wherein the catalyst particulates comprise a mineral support and an oxide or acid addition salt of a Group 3-16 metal; a mixing zone to combine 100 parts by weight of the heavy oil, from about 5 to 100 parts by weight water, and from about 1 to 20 parts by weight solid catalyst particulates into a feed mixture comprising an emulsion; a transfer line to supply the emulsion from the mixing zone to a pyrolysis zone; a combustion gas source to supply a combustion gas to heat the pyrolysis zone; a control system to maintain the pyrolysis zone at a temperature, pressure and residence time to form a pyrolyzate vapor phase; and a vapor line to receive the pyrolyzate vapor phase from the pyrolysis zone.

EXAMPLES

Catalyst Materials:

Catalyst materials according to the present invention and comparative catalyst materials were used in the following examples. The inventive solid catalyst materials were derived from oil-based drill cuttings (OBDC) comprising an average of 12 wt % oil, 12 wt % water and 76 wt % solids, by weight of the OBDC, which were chemically and thermally treated, and obtained as the low oil solids recovered from the second reactor ("CAT-A") or the fines obtained from the effluent solids cyclone separator ("CAT-B"), according to the process disclosed in U.S. Pat. No. 8,641,895. To produce the solid catalyst, OBDC were pretreated at 11 metric tons per hour in the first reactor (peptizer) with concentrated sulfuric acid at 2 percent by weight based on the weight of the OBDC to obtain a peptizate at 85° C., having a pH between 6 and 7.5, which was fed to the second reactor (desorber) where it was mixed with hot oxygen-lean combustion gas at 1000°-1100° C., i.e., fuel rich combustion to produce a low oxygen combustion gas, to obtain an operating temperature at the outlet end of the second reactor of 280°-300° C. CAT-A contained 1.5 wt % hydrocarbon and 1.5 wt % water. CAT-B contained 2 wt % hydrocarbon and 5 wt % water. The solid catalysts were subject to XRD and microscopic analysis and characterization. The leachate metal composition and crystallographic properties are shown in Table 1.

TABLE 1

| | CATALYST: | |
|---|---|---|
| | CAT-A | CAT-B |
| Element | Selected XKD Elemental Composition, Solid Phase (wt % total solid) | |
| Si | 11.55 | 11.54 |
| Ba | 10.02 | 15.56 |
| Ca | 11.26 | 8.34 |

TABLE 1-continued

| | | |
|---|---|---|
| S | 3.84 | 4.1 |
| Al | 3.98 | 4.25 |
| Fe | 3.25 | 3.91 |
| Mg | 1.22 | 1.27 |
| Na | 1.21 | 0.59 |
| K | 1.12 | 1.03 |
| Sr | 0.91 | 0.93 |
| Pb | 0.27 | 0.57 |

| Mineral | Crystalline Phase Components (wt % crystal phase) | |
|---|---|---|
| $BaSO_4$ | 17 | 15 |
| $SiO_2$ | 8 | 4 |
| $CaCO_3$ | 27 | 16 |
| $CaSO_4$ | 8 | 4 |
| Albite | 40 | 64 |

| Mineral | Crystal Size | |
|---|---|---|
| $BaSO_4$ | 0.5-45 μm | 0.5-45 μm |
| $SiO_2$ | 37-500 μm | 37-45 μm |
| $CaCO_3$ | 45-100 μm | 45-100 μm |
| $CaSO_4$ | 1-37 μm | 1-10 μm |
| Albite | 0.25-350 μm | 0.25-35 μm |

Samples of CAT-A and CAT-B were calcined at 580° C. to produce CAT-A2 and CAT-B2, respectively. CAT-A2A was obtained by heating CAT-A to 100° C. and holding the temperature for 20 minutes, followed by heating to 150° C. and holding for 60 minutes, and then heating to 700° C. at 5° C./min and holding at 700° C. for 3 hours.

CAT-A3 was obtained by washing CAT-A with water and drying prior to use to investigate the effect of removing water-soluble salt thought to exist on the surface of the solid catalyst.

A sample of the OBDC as received (19.75 wt % water, 16.59 wt % oil) was washed with hexane (13.53 wt % water, 3.79 wt % oil) and dried in an oven at 80° C. for two hours to obtain CAT-D (4.21 wt % water, 3.16 wt % oil). Accordingly, CAT-D was OBDC which were neither treated with acid nor thermally processed by peptization/desorption.

Other comparative particulated catalyst materials used in the following examples included ZSM-5 zeolite (Aldrich) ("CAT-C"); bentonite clay (Aldrich) ("CAT-E"); concentrated sulfuric acid; cobalt metal; nickel metal; molybdenum metal; iron oxide ($Fe_2O_3$); and/or salt (NaCl), all of which were utilized as purchased without further processing.

CAT F was obtained by loading Fe(III) on bentonite. The bentonite was an acid-treated calcium bentonite and was prepared by mixing the as-received bentonite (100 mesh) with 1 M aqueous NaCl at a 1:2 weight ratio (1 part by weight bentonite, 2 parts by weight brine), stirring for 1 hour and then allowing the mixture to sit for 16-24 hours. The excess brine was removed and the bentonite rinsed with 5 parts by weight of distilled water per 1 part by weight bentonite. The excess water was removed, the bentonite dried at 135° C. for 4-6 hours and ground to pass through a 40 mesh screen.

The Fe(III) was prepared by mixing 3 parts by weight 100 mesh carbon steel shavings with 1 part by weight aqua regia (1 part by weight nitric acid, 3 parts by weight hydrochloric acid, 2 parts by weight water) with constant stirring. Two additional aliquots of aqua regia (1 part by weight each) were added and the temperature increased to 95° C. The slurry was filtered, the recovered solids dried in an oven at 100° C., ground to pass a 100 mesh screen, and slurried at 1 part by weight oxidized iron in 24 parts by weight distilled water. Then 2 parts by weight of the Fe(III) slurry were mixed with 3 parts by weight of the dried 40 mesh bentonite, the resulting slurry dried to 400° C. for 2 hours in an oven, and the solids cooled and ground to pass 60 mesh screen.

Metals Composition of CAT-A, CAT-A2, CAT-B, CAT-B2:

The solid catalysts materials were further analyzed for various metals using microwave assisted acid digestion of siliceous and organically based matrices coupled with inductively coupled plasma-atomic emission spectrometry according to EPA 3052/6010. The results are shown in Table 2.

TABLE 2

Relative amounts of metals EPA 3052/6010

| Element | CAT-A (mg/kg) | CAT-A2 calcined (mg/kg) | CAT-B (mg/kg) | CAT-B2 calcined (mg/kg) | CAT-D (mg/kg) |
|---|---|---|---|---|---|
| Cd | 2 | 2 | 2.8 | 2.7 | 2 |
| Pb | 413.04 | 448.45 | 553.33 | 632.36 | 734.39 |
| Ag | 2.43 | 5.01 | 3.18 | 3.91 | 2 |
| Cr | 41.96 | 44.64 | 31.38 | 34.87 | 35.31 |
| Cu | 79.17 | 85.99 | 108.00 | 104.01 | 94.59 |
| Fe | 21314.46 | 21001.00 | 15353.85 | 14108.22 | 13510.2 |
| Sn | <10.00 | <10.00 | <10.00 | <10.00 | <10.00 |
| Zn | 376.14 | 388.39 | 558.67 | 564.13 | 195.92 |
| Bi | <10.00 | <10.00 | <10.00 | <10.00 | <10.00 |

As these data show, the metals composition of the solid catalyst samples and the untreated CAT-D were similar regardless of the thermal processing history. These data also show very little difference between the calcined samples CAT-A2 and CAT-B2 and the non-calcined samples CAT-A and CAT-B. Comparison of CAT-A with CAT-B (the larger particulates vs. the fines) shows an increase in the concentrations for lead, silver, copper and zinc of 30-45% in the fines (CAT-B), and a decreases of nearly 25% in iron and chromium in the fines (CAT-B) relative to the larger particles (CAT-A). The same is true for the corresponding calcined samples. These data further show that the majority metallic element is iron. Although not bound by theory, the changes in composition of the treated solids (CAT-A, CAT-B) relative to the untreated OBDC (CAT-D) may be at least partially responsible for the enhanced catalytic effects exhibited for recovery of upgraded hydrocarbons from heavy oil, as described below.

Additional testing was conducted on two other samples of CAT-A and CAT-B, prepared as discussed above. The tests were conducted to determine the concentration of other trace metals according to EPA3050MOD/6010, and indicated the additional presence of nickel, silver, and vanadium. The results are shown in Table 3.

TABLE 3

Relative amounts of metals EPA3050MOD/6010

| Element | CAT-A wet basis (mg/kg) | CAT-A dry basis (mg/kg) | CAT-B wet basis (mg/kg) | CAT-B dry basis (mg/kg) |
|---|---|---|---|---|
| Cd | 4.10 | 4.15 | 4.50 | 4.57 |
| Pb | 1845.00 | 1865.52 | 1617.00 | 1638.21 |
| Ag | 6.40 | 6.47 | 6.00 | 6.10 |
| Cr | 38.70 | 39.13 | 51.90 | 52.74 |
| Cu | 90.30 | 91.30 | 88.40 | 89.84 |
| Fe | 16210.00 | 16390.29 | 17870.00 | 18160.57 |
| Sn | <10.00 | <10.00 | <10.00 | <10.00 |
| Zn | 587.60 | 594.14 | 604.20 | 614.02 |
| Bi | <10.00 | <10.00 | <10.00 | <10.00 |

TABLE 3-continued

| Relative amounts of metals EPA3050MOD/6010 | | | | |
|---|---|---|---|---|
| Element | CAT-A wet basis (mg/kg) | CAT-A dry basis (mg/kg) | CAT-B wet basis (mg/kg) | CAT-B dry basis (mg/kg) |
| Ni | 47.10 | 47.62 | 49.30 | 50.10 |
| Ag | 6.40 | 6.47 | 6.00 | 6.10 |
| V | 24.70 | 24.97 | 31.70 | 32.22 |

Emulsion Stability and Properties:

Feeding of the crude oil emulsion into the distillation/pyrolysis apparatus according to embodiments disclosed herein is facilitated by the ability of the solid catalyst to readily combine with the heavy oil and/or heavy oil and water to form a mixture having reduced viscosity relative to the heavy oil. Mixing the heavy oil with the solid catalyst reduced the viscosity to facilitate pumping or otherwise conveying the material at temperatures well below those otherwise required to pump the heavy oil. In some instances, for example, addition of the solid catalyst to the heavy oil allows for a pumpable mixture at 25° C. to about 40° C.

In embodiments, the solid catalysts are preferably added to the feed (the heavy oil or the heavy oil and water) prior to feeding the mixture the pyrolysis apparatus. Accordingly, the temperature relation to sample viscosity when combined with varying amounts of catalyst was determined.

The heavy crude oil sample was combined with 5 wt % (oil basis) CAT-A and varying amounts of water. The electrical stability (in volts) of the emulsion according to API 13B-2, and the viscosity of each mixture was determined at three different temperatures. The results are provided in Table 4A.

TABLE 4A

| Emulsion viscosity and stability | | | | | | |
|---|---|---|---|---|---|---|
| | Temp. | | | | | |
| Water, | 40° C. | | 130° C. | | 250° C. | |
| wt % Oil basis | Viscosity (mPa-s) | Stability (V) | Viscosity (mPa-s) | Stability (V) | Viscosity (mPa-s) | Stability (V) |
| 0 | 10480 | 1818 | 1652 | 2000 | 32 | 2000 |
| 20 | 8380 | 1239 | 256 | 2000 | 32 | 2000 |
| 30 | 7048 | 712 | 210 | 2000 | 32 | 2000 |
| 40 | 6264 | 598 | 164 | 1902 | 32 | 2000 |
| 50 | 5664 | 539 | 158 | 1680 | 32 | 2000 |

As these data show, the viscosity of the mixture decreases dramatically with an increase in temperature. In addition, the amount of water added to the oil affects both viscosity and stability of the emulsion. As these data further show, the most dramatic reduction in viscosity with the least amount of change in the stability occurs at a temperature of about 130° C. and a water concentration of about 20 wt % (oil basis). Accordingly, further tests were conducted at a water concentration from about 20 wt % to about 50 wt % (oil basis).

Testing was conducted to determine the effect of the order of addition on the final viscosity of the heavy crude/water/catalyst emulsion. The viscosity of a heavy crude sample was first determined. In a first example, 30 wt % water (oil basis) was first added to the heavy crude and mixed in a blender for 5 minutes. The viscosity was then determined (Brookfield, spindle 6 or 7). Next, 5 wt % CAT-A (oil basis) was added and mixed for 5 minutes. The viscosity was then determined. The resulting Emulsion 1 was then allowed to cool to 34° C. and the viscosity determined again. A second example was conducted except that CAT-A was first combined with the heavy crude followed by the water. The reduction in viscosity from heavy crude adjusted for temperature was then calculated. These data are shown in Table 4B.

TABLE 4B

| Effect of order of addition | | | | | |
|---|---|---|---|---|---|
| Example | Order of addition | Viscosity (mPa-s) | End T (° C.) | T delta (° C.) | Reduction in viscosity* (%) |
| Heavy Crude | NA | 30,100 | 32 | 0 | 0 |
| 1 | Water | 12560 | 38 | 6 | 29.1 |
| | CAT-A | 5760 | 46 | 8 | 42.5 |
| | Emulsion 1 | 14480 | 34 | 0 | 41.3 |
| 2 | CAT-A | 6240 | 46 | 14 | 68.4 |
| | Water | 13280 | 42 | −4 | 32.8 |
| | Emulsion 2 | 19280 | 34 | 0 | 0 |

*% reduction in viscosity is relative to the viscosity of the heavy crude at the same temperature, as shown in Table 4C;
NA = not applicable.

These data show that slightly lower viscosity is obtained by mixing the water with the heavy oil first, and then mixing CAT-A with the oil-water mixture. The viscosity of a heavy crude sample and the corresponding Emulsion 1 was determined over a temperature range from 30° C. to 60° C. These data are shown in Table 4C.

TABLE 4C

| Emulsion and heavy crude viscosity vs. temperature | | | |
|---|---|---|---|
| Temp. (° C.) | Viscosity Emulsion 1 (mPa-s) | Viscosity heavy crude (mPa-s) | % reduction in viscosity |
| 30 | 19,760 | 35,000 | 43.5 |
| 32 | 17,920 | 29,539* | 40.4 |
| 34 | 16,080 | 24,658* | 34.8 |
| 38 | 12,400 | 17,703* | 30.0 |
| 40 | 10,560 | 14,200 | 25.6 |
| 42 | 9,568 | 13,140* | 27.2 |
| 46 | 7,590 | 10,020* | 24.3 |
| 50 | 5,600 | 7,200 | 22.2 |
| 60 | 3,200 | 4,500 | 28.8 |

*The value of the heavy oil viscosity was extrapolated from a power fit of data acquired at 30, 40, 50 and 60° C. according to the power equation viscosity = 9E+08 * (temp ° C.)$^{(-2.979)}$T; $R^2$ = 0.9984.

The increase in temperature upon addition was due in part to the agitation. However, these data also show an exothermic event upon addition of CAT-A, and it is clear that the addition of CAT-A has a pronounced effect on the viscosity even without the addition of water.

In the following examples, the heavy oil/catalyst/water mixture was heated in batch mode in a retort reactor equipped with a condenser to condense overhead vapors. In some runs as indicated, a layer of silica sand was inserted in the bottom of the reactor. The heavy oil sample was first mixed with water and the appropriate catalyst and the emulsion charged into the reactor. The emulsion was prepared with the indicated proportion of catalyst solids, total water (added water plus any water in the oil sample), and oil (net oil in the sample as adjusted for water and solids in the heavy oil sample). The reactor was then heated to the indicated temperatures over the indicated time period, over which the catalytic pyrolysis product was condensed, collected and weighed. The recovery of the oil was based on the total amount of oil originally present in the heavy oil sample, corrected for added solids, e.g., solid catalyst and/or sand. These data are shown in Table 5.

TABLE 5

| | Reactor Conditions and Charge | | | | | | Results | |
|---|---|---|---|---|---|---|---|---|
| | | | | | | | Oil | Net |
| Run | Time, min | T range, ° C. | Water, wt %* | Cat. | Solids, wt %* | Other, wt %* | Recovered wt %* | Residue, wt %* |
| BL 1 | 70 | 23-522 | 0 | 0 | | | 52 | 25 |
| BL 2 | 95 | 23-465 | 0 | 0 | | | 60 | 23 |
| 1 | 60 | 32-513 | 30 | 0 | | | 72 | 24.4 |
| 2 | 105 | 23-500 | 50 | D | 5 | | 59 | 19.4 |
| 3 | 110 | 23-500 | 25 | A | 5 | | 62 | 22.6 |
| 4 | 100 | 25-375 | 50 | A | 5 | | 81 | ND |
| 5 | 76 | 25-500 | 50 | A | 10 | | 80 | ND |
| 6 | 50 | 25-375 | 50 | A | 5 | | 88 | ND |
| 7 | 91 | 25-500 | 25 | A2 | 2.5 | SB | 74 | 15.6 |
| 8 | 100 | 25-500 | 30 | A2A | 5 | | 82 | 17 |
| 9 | 95 | 25-500 | 30 | A3 | 5 | | 72 | 15 |
| 10 | 100 | 25-500 | 50 | B | 10 | | 81 | ND |
| 11 | 120 | 25-500 | 50 | B | 10 | SB | 60** | ND |
| 12 | 188 | 36-275 | 25 | C | 2.5 | | 49 | 35 |
| 13 | 173 | 25-600 | 25 | C | 5 | $A^-$, 0.5 | 63 | 27 |
| 14 | 170 | 25-490 | 50 | C | 5 | $A^-$, 1 | 61 | ND |
| 15 | 188 | 36-275 | 50 | C | 5 | SB | 63 | ND |
| 16 | 95 | 25-500 | 30 | $Fe_2O_3$/NaCl | 1/1 | | 70 | 15 |
| 17 | 188 | 36-275 | 50 | E | 5 | SB | 62 | ND |
| 18 | 95 | 25-500 | 50 | Co/Ni | 1/1 | | 62 | ND |
| 19 | 95 | 25-500 | 50 | Co/Mo | 1/1 | | 61 | ND |
| 20 | 95 | 25-500 | 50 | Co | 1 | | 62 | ND |

Notes for Table 5:
*All contents wt % oil basis;
**solids built up within the reactor;
BL = baseline;
$A^-$ = $H_2SO_4$;
SB = sand bed;
ND = not determined.

Baseline Run, Heavy Crude Pyrolysis, No Water or Catalyst Added:

A sample of heavy crude oil (viscosity 31.6 kPa at 25° C.; density 0.989 g/cm$^3$) was fed into a small retort reactor, equipped with an electric resistance heater and an overhead condenser. The heater was turned on and the retort reached a temperature of 500° C. after 70 minutes. The oil recovery was just 52 wt % in Baseline 1 and 60 wt % in the repeat Baseline 2.

Run 1 (Comparative)—Heavy Crude Pyrolysis, 30 wt % Water:

An oil/water emulsion was prepared by mixing the heavy crude oil with about 30 wt % water, without any catalyst solids. The emulsion was fed to the retort reactor which reached a temperature of 500° C. after 60 minutes. The oil recovery improved to 72 wt %.

Run 2—Heavy Crude Pyrolysis, 30 wt % Water and 5 wt % CAT-D:

An oil/water emulsion was prepared by mixing 200.10 g of heavy crude oil (viscosity 31.6 kPa at 25° C.; density 0.989 g/cm$^3$), 100.23 g of water and 10.30 g of CAT-D. The emulsion (181.17 g) was fed into the retort which upon heating reached a temperature of 500° C. after 105 minutes. It was observed that only water was present in the overhead fractions up to 220° C. The majority of the oil was recovered around 350° C. The presence of sulfur was apparent from the dark color and odor of the lower temperature fractions. The higher temperature fractions were progressively darker. These results were similar to the use of water alone in Run 1, and the oil recovery was no better than baseline.

Runs 3-6—Heavy Crude Pyrolysis, 25-50 wt % Water and 5-10 wt % CAT-A:

In these runs, heavy crude oil was mixed with CAT-A (5-10 wt %) and water (25-50 wt %), and placed in the retort reactor, which, upon heating, reached the temperature indicated after the specified time period, over which fractions were collected overhead. In these runs, two distinctly different cuts were recovered below 220° C., initially an emulsion and then a light oil, indicating that CAT-A promoted the formation of a low boiling point hydrocarbon fraction. The diminished presence of sulfur was also apparent relative to the heavy crude oil, as evidenced by the light yellow oil collected from the reactor, along with the absence of sulfur odor in the collected fractions. This is in sharp contrast to CAT-D, which had essentially no effect on the recovered oil. Moreover, the oil recovery in Runs 4-6 was better than with the OBDC (cf. Run 2, 5 wt % CAT-D, 50 wt % water). Run 4 with 50 wt % water and 5 wt % CAT-A, showed a dramatic increase in the amount of oil recovered (81 wt %) relative to the heavy crude alone and/or heavy crude/water. Run 5 with 50 wt % water and 10 wt % CAT-A, was comparable to Run 4 even though the quantity of CAT-A had been doubled in Run 5. CAT-A exhibited a markedly different behavior as a catalyst than CAT-D, with catalytic properties apparently activated by the acid peptizing and/or the thermal processing of the OBDC with hot, oxygen-lean combustion gases.

Runs 7 and 8—Heavy Crude Pyrolysis, 25-30 wt % Water and 2.5 wt % CAT-A2 or 5 Wt % CAT-A2A:

Runs 7 and 8 with calcined CAT-A were comparable to Runs 3-6. CAT-A2A, calcined at the higher temperature, had better oil recovery than the lower-temperature calcination of CAT-A2.

Run 9—Heavy Crude Pyrolysis, 30 wt % Water and 5 wt % CAT-A3:

Washed CAT-A showed a slight reduction in recovered oil, thus suggesting a positive effect when salt is present and/or added. Accordingly, in embodiments, the solid catalyst further comprises salt, either present on the solid catalyst or added to the process.

Runs 10 and 11—Heavy Crude Pyrolysis, 50 wt % Water and 10 wt % CAT-B:

Run 10[7] with 50 wt % water and 10 wt % CAT-B, was comparable to Runs 5 and 6, indicating fines were generally equivalent to CAT-A. Run 11[8] was a repeat of Run 10[7] with a bed of sand placed in the retort reactor, but the marked reduction of the oil recovered is thought to have occurred due to solids build up within the reactor.

Runs 12-15—Heavy Crude Pyrolysis with CAT-C:

In Run 12, CAT-C(zeolite) with water was no better than the heavy crude alone without water. Adding sulfuric acid or using a sand bed with CAT-C(Runs 13-15) were no better than pyrolysis with only water and/or untreated OBDC added as in Runs 1 and 2.

Run 16—Heavy Crude Pyrolysis, Water with $Fe_2O_3$ and NaCl:

Run 16 replaced CAT-A with NaCl and $Fe_2O_3$, the major components in the solid catalyst according to the compositional analysis above. However, the oil recovery results were similar to using water alone as in Run 1.

Runs 17-20—Heavy Crude Pyrolysis, Water with Other Catalysts:

Runs 16-20 with bentonite clay (CAT-E), cobalt, nickel, and/or molybdenum, were also similar to pyrolysis of the heavy oil alone or with water and/or OBDC as in the baseline or Runs 1-2. Bentonite was selected as a common drilling fluid additive present in the OBDC, whereas the metals, nickel, cobalt and molybdenum, are present in CAT-A.

As these data show, the inventive examples increase the amount of oil recovered as catalytic pyrolysis product from about 60 wt % up to above 80 wt % of the oil originally present in oil containing material. Furthermore, water is consumed during the process.

In embodiments, the instant process produces an oil having greatly improved properties when compared to the heavy crude starting material. The physical properties of the heavy oil and the catalytic pyrolysis product according to an embodiment (i.e., the overhead fraction collected from the pyrolysis reactor in Run 4) are listed below in Table 6:

TABLE 6

| Property | Unit | Heavy Oil | Run 4 Pyrolyzate |
|---|---|---|---|
| Density | g/cm$^3$ | 0.977 | 0.85 |
| Viscosity @ 25° C. | Pa-s | 13.58-19 | 0.020-0.30 |
| API gravity | ° API | 13 | 35 |
| Boiling point | ° C. | 95 | >200 |
| Flash point | ° C. | 66 | >90 |
| Aniline point | ° C. | ND | >68 |

Figure 12:
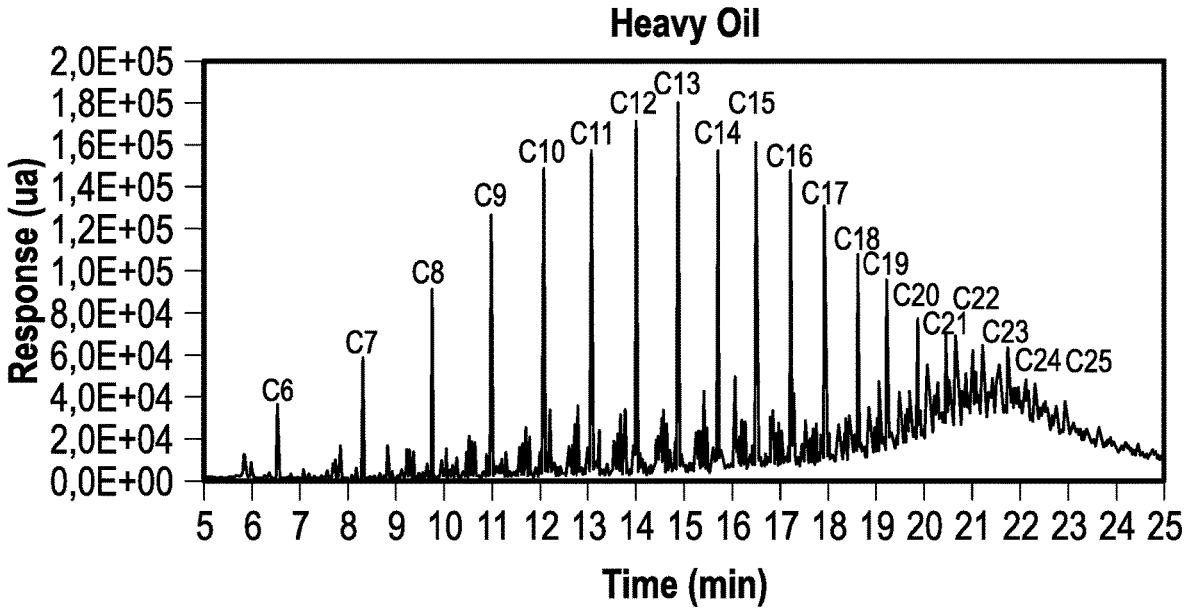
FIG. 12 shows a GC/MS chromatogram of a baseline heavy crude oil as discussed in the examples below.
Figure 13:
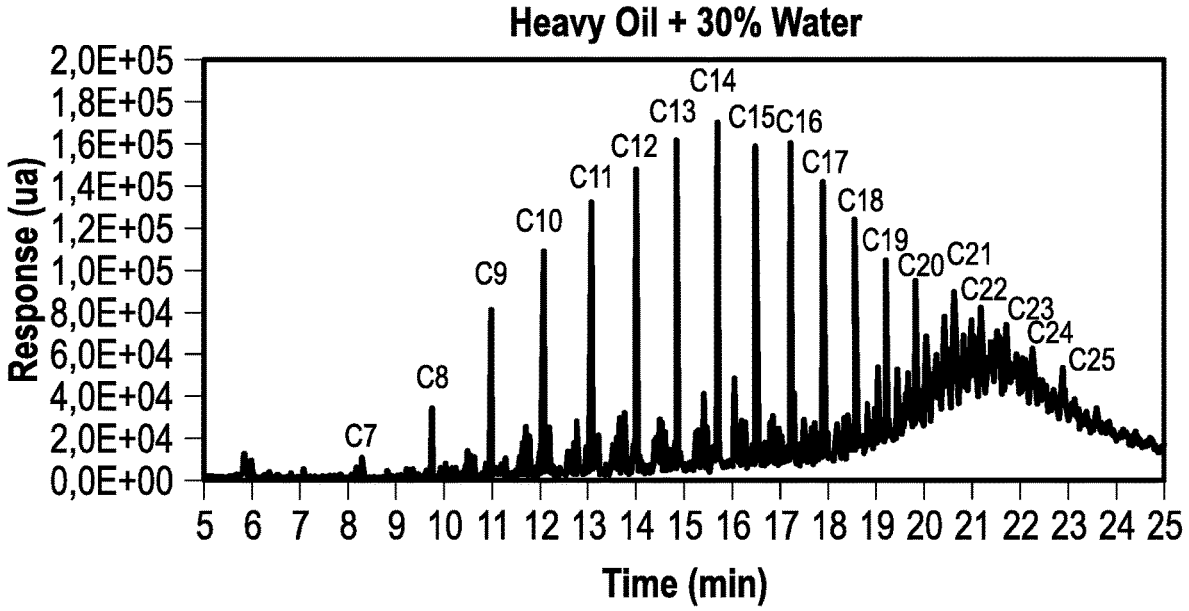
FIG. 13 shows a GC/MS chromatogram of a pyrolysis product of the same heavy crude oil produced from a mixture with water in Run 1 of the examples discussed below.
Figure 14:
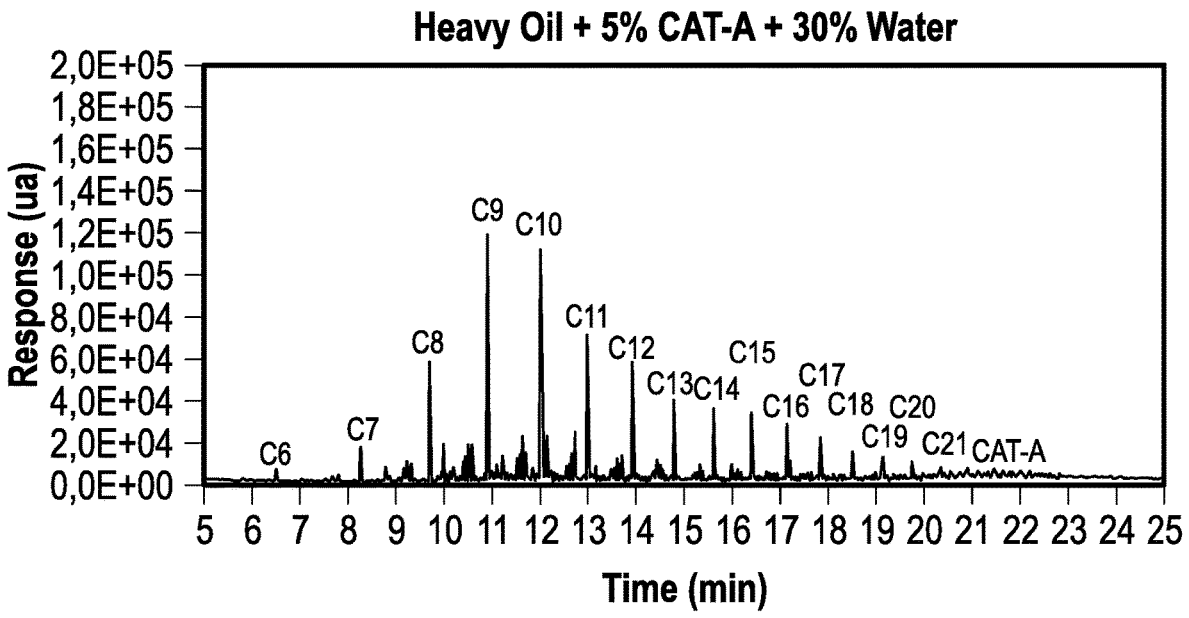
FIG. 14 shows a GC/MS chromatogram of a catalytic pyrolysis product from the same heavy crude oil produced from a mixture with catalyst particulates and water in Run 3 of the examples discussed below according to embodiments of the present invention.

Mass spectral analysis of the baseline heavy oil, the oil obtained as the pyrolyzate from Run 1, and the oil obtained as the pyrolyzate from Run 3, are shown in FIGS. 12, 13, and 14, respectively. These data show that the catalyst system according to embodiments of the instant disclosure produces a transformation of the lighter hydrocarbons into heavier hydrocarbons through catalysis, pyrolysis and possibly hydrogenation due to the gas shift reaction involving the water. These data show a decrease in the concentration of both lighter and heavier hydrocarbons relative to the heavy crude, with a corresponding increase in the concentration of hydrocarbons in the $C_8$ to $C_{15}$ range. Accordingly, these data suggest that the catalyst system is responsible for converting both low and high molecular weight hydrocarbons into mid-range hydrocarbons thus, lowering the viscosity and improving the properties of the recovered oil relative to the heavy crude.

Saturates, Aromatics, Resins and Asphaltenes (SARA) Testing:

These tests are performed on a crude oil and the pyrolyzate obtained from a mixture of 100 parts by weight of the crude oil, 30 parts by weight water, and 5 parts by weight of a CAT-A sample in the manner described for Run 4 above. These tests were performed on a mixture of 100 parts by weight heavy oil, 30 parts by weight water, and 5 parts by weight of a CAT-A sample. As seen in Table 7, the pyrolyzate had lower levels of resins and asphaltenes, and higher levels of aromatics.

TABLE 7

| SARA Component | Crude Oil | CAT-A/Water Pyrolyzate |
|---|---|---|
| Saturates, wt % | 56.2 | 55.4 |
| Aromatics, wt % | 12.0 | 36.1 |
| Resins, wt % | 22.4 | 8.0 |
| Asphaltenes, wt % | 9.4 | 0.5 |

Thermogravimetric, Calorimetric and Micropyrolysis Tests:

These tests are performed on a mixture of 65 parts by weight heavy oil, 30 parts by weight water, and 5 parts by weight of a CAT-A sample. Thermogravimetric analysis confirms more volatiles are released by the mixture than the base heavy oil alone. Differential scanning calorimetry shows a large exotherm upon continued heating the mixture above the boiling point of water, indicative of an exothermic chemical reaction, whereas the baseline heavy crude oil does not. Micropyrolysis similarly confirms that yields of $C_8$-$C_{18}$ alkanes from the heavy oil/CAT-A/water mixture are markedly increased relative to the heavy oil alone, whereas a very low level of lighter hydrocarbons are observed for the mixture and a very high level for the heavy oil alone.

Thermal Tests with Aqueous CAT-F Slurry (No Oil):

A laboratory bench scale reactor was used in this test of a slurry of 5 parts by weight CAT-F mixed in 30 parts by weight water. The reactor was externally (indirectly) heated by combustion flue gas flowing around the outside of the bottom of the enclosed reactor. An outlet pipe from the reactor was connected to a condenser for collection of a condensate from a drain into a collection flask and collection of noncondensable gases from an outlet into a plastic bag. The heater was turned on to heat the reactor, and the heater output was unchanged throughout the duration of the test. The sealed reactor heated up to a temperature of 480-500° C. and no further temperature increase was observed.

The Cat-F slurry was then injected at ambient temperature from a pressurized tank (2 kg/cm$^2$) into a nozzle pointed downwardly into the reactor and positioned ⅓ of the way from the top toward the bottom of the reactor. In one run, the slurry injection rate was 6.7 mL/min and the temperature at the top of the reactor gradually increased 50° C. over a period of 12 minutes and a noncondensable gas was collected in the bag. The collected gas tested positive for flammability when a small stream squirted out of the bag through a nozzle toward a yellow hydrocarbon flame, as indicated by travel of the flame up the stream toward the bag; and a change in the color of the flame from yellow to bluish white suggested the presence of hydrogen or another highly flammable gas.

In other tests at higher slurry injection rates of 7.2 mL/min for 14 minutes, and 20 mL/min for 21 minutes, the temperature rose more slowly (7.2 mL/min) or decreased (20 mL/min), respectively. These results show that there was an exothermic catalyst and/or water-catalyst reaction that generated a flammable gas, and suggest hydrogen may be evolved in situ in processes employing CAT-F and water according to some embodiments of the invention.

Steady State Pyrolysis Tests:

These tests used a pilot plant scale reactor in accordance with the direct-heating design shown in FIG. 10, except that only one exchanger downstream from the cyclone was used and there was no solids discharge from the reactor so solids accumulated in the bottom of the reactor during the test. The reactor was heated by combustion flue gas flowing into the side of the reactor near the bottom. A slurry injection nozzle pointed downwardly (countercurrent to the flue gases) was positioned ⅓ of the way from the top of the reactor toward the bottom to provide a conical spray pattern. The reactor was equipped with thermocouples in the combustion chamber, within the reactor, at the top of the reactor, and in the cyclone.

An emulsion of heavy crude (API<10°) was prepared by heating the crude oil to 70° C., adding water and mixing with an overhead mixer for 10 minutes, then adding the catalyst particulates and mixing for another 5 minutes. The resulting emulsion was composed of 5 parts by weight catalyst particulates, 30 parts by weight water (added water plus water in heavy oil sample), and 65 parts by weight oil (heavy oil less water and solids). The reactor was brought to steady state at a reactor temperature between 400° C. and 600° C., while maintaining the combustion at a steady rate between 1100° C. and 1200° C., adjusting the emulsion feed rate as necessary to obtain the desired temperatures, and collecting the pyrolyzate liquids from the condenser.

Figure 15:
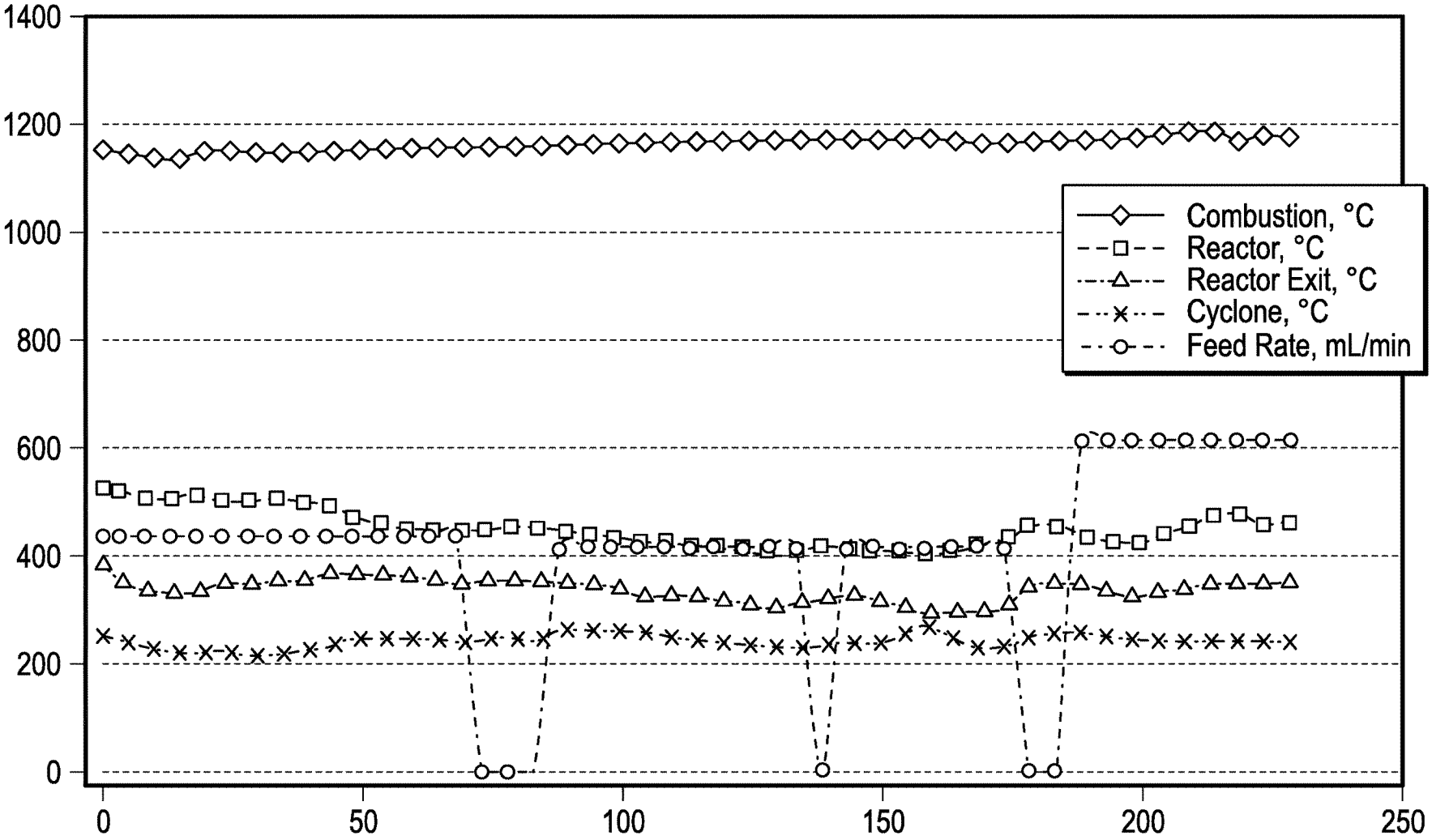
FIG. 15 shows operating conditions for a pyrolysis process discussed in the examples below according to embodiments of the present invention.

Typical operating conditions for these tests using emulsions made with CAT-A are shown in FIG. 15. In the case shown, the reactor temperature was maintained generally between 400° C. and 600° C., the reactor outlet temperature was generally between 300° C. and 400° C., and the cyclone temperature was between 200° C. and 300° C. Note the slurry feed rate dropped to 0 whenever the injection nozzle plugged temporarily. The reactor was heated up to operating temperature with combustion gases only before the slurry feed was started (not shown), and then the temperature of the reactor slowly declined until steady state was reached with the temperature near 400° C. after 1-2 hours. Increasing the slurry feed rate from near 400 mL/h to 600 mL/h increased the reactor temperature, indicating a reaction exotherm.

When the feed slurry was prepared using CAT-F with the heavy oil and water, and fed to the pilot plant reactor, the recovered oil was a low viscosity, low-density (API>30°) liquid representing a recovery of 90 wt % of the oil from the slurry, while non-condensable gases represented just 4 wt % of the oil in the slurry. This compared favorably to the typical recovery of 80-85 wt % of the oil when CAT-A was used.

The invention has been described above with reference to numerous embodiments and specific examples. Many variations will suggest themselves to those skilled in this art in light of the above detailed description. All such obvious variations are within the full intended scope of the appended claims.

What is claimed is:

1. An emulsion having utility as a reactor feedstock, comprising:

100 parts by weight heavy oil;

from about 5 to about 100 parts by weight water; and from about 1 to about 20 parts by weight solid catalyst particulates comprising ferric ions and chloride ions supported on clay.

2. The emulsion of claim 1 wherein the catalyst particulates comprise particulates recovered from a thermal desorption process in which an oil contaminated substrate comprising a peptizable matrix component selected from acid-reactive clays and minerals, has been contacted with an acidic reagent to form a peptizate, and the peptizate mixed with a combustion effluent gas comprising less than about 1 volume percent oxygen, under turbulent conditions at a temperature above 200° C., to form a light phase comprising desorbed oil and a dense phase from which the catalyst particulates are recovered.

3. The emulsion of claim 1, wherein the catalyst particulates have been thermally treated at a temperature above 200° C.

4. The emulsion of claim 1, wherein the clay comprises acid-treated clay.

5. The emulsion of claim 1, wherein the clay comprises bentonite.

6. The emulsion of claim 1, wherein the catalyst particulates comprise the product of:

recovering a solid reaction product from contacting excess iron shavings with an aqueous mixture of hydrochloric and nitric acids;

treating a clay with an aqueous sodium chloride brine;

drying the brine-treated clay;

combining the recovered solid reaction product, the dried, brine-treated clay, and water to form a mixture; and thermally treating the mixture at a temperature above 200° C.

7. The emulsion of claim 1, comprising from about 20 to about 50 parts by weight of the water, and from about 5 to about 10 parts by weight of the catalyst particulates.

8. The emulsion of claim 1, having an electrical stability of greater than 1600 V, when determined according to API 13B-2 at 130° C.

9. The emulsion of claim 1, having an apparent viscosity at 30° C. and 100 $s^{-1}$ at least 30% lower than the heavy oil alone.

10. A reactor system, comprising:

a charge of the emulsion of claim 1;

a transfer line to supply the emulsion to a reaction chamber;

a combustion gas source to supply a combustion gas to heat the reaction chamber;

a control system to maintain the reaction chamber at a temperature, pressure and residence time to form a pyrolyzate vapor phase; and a vapor line to receive the pyrolyzate vapor phase from the reaction chamber.

11. The reactor system of claim 10 wherein the absolute pressure in the reaction chamber is from about 1 to 1.5 atm and the pyrolyzate vapor phase exits from the reactor at a temperature above 200° C.

12. The reactor system of claim 11 wherein the pyrolyzate vapor phase exits from the reaction chamber at a temperature above 400° C. up to about 600° C.

13. The reactor system of claim 11 wherein the pyrolyzate vapor phase exits from the reaction chamber at a temperature 400° C. up to about 500° C.

14. The reactor system of claim 10, further comprising a pump to pump the emulsion through a line to the reaction chamber.

15. The reactor system of claim 10, further comprising a spray nozzle for injecting the emulsion into the reaction chamber.

16. The reactor system of claim 10 wherein the catalyst particulates comprise particulates recovered from a thermal desorption process in which an oil contaminated substrate comprising a peptizable matrix component selected from acid-reactive clays and minerals, has been contacted with an acidic reagent to form a peptizate, and the peptizate mixed with a combustion effluent gas comprising less than about 1 volume percent oxygen, under turbulent conditions at a temperature above 200° C., to form a light phase comprising desorbed oil and a dense phase from which the catalyst particulates are recovered.

17. The reactor system of claim 10, wherein the catalyst particulates have been thermally treated at a temperature above 200° C.

18. The reactor system of claim 10, wherein the clay comprises bentonite.

19. The reactor system of claim 10, wherein the catalyst particulates comprise the product of:

recovering a solid reaction product from contacting excess iron shavings with an aqueous mixture of hydrochloric and nitric acids;

treating a clay with an aqueous sodium chloride brine;

drying the brine-treated clay;

combining the recovered solid reaction product, the dried, brine-treated clay, and water to form a mixture; and thermally treating the mixture at a temperature above 200° C.

20. The reactor system of claim 10, wherein the emulsion comprises from about 20 to about 50 parts by weight of the water, and from about 5 to about 10 parts by weight of the catalyst particulates.

21. The pyrolysis system of claim 10, wherein the emulsion has an electrical stability of greater than 1600 V, when determined according to API 13B-2 at 130° C.

22. The pyrolysis system of claim 10, wherein the emulsion has an apparent viscosity at 30° C. and 100 $s^{-1}$ at least 30% lower than the heavy oil alone.

* * * * *